US006874863B2

(12) United States Patent
Usui et al.

(10) Patent No.: US 6,874,863 B2
(45) Date of Patent: Apr. 5, 2005

(54) LIQUID EJECTION HEAD

(75) Inventors: Minoru Usui, Nagano (JP); Fujio Akahane, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 52 days.

(21) Appl. No.: 10/647,429

(22) Filed: Aug. 26, 2003

(65) Prior Publication Data

US 2004/0119780 A1 Jun. 24, 2004

(30) Foreign Application Priority Data

Aug. 26, 2002 (JP) ..... P2002-245561
Dec. 19, 2002 (JP) ..... P2002-368171
Aug. 7, 2003 (JP) ..... P2003-288490

(51) Int. Cl.[7] ..... B41J 2/21
(52) U.S. Cl. ..... 347/40; 347/43
(58) Field of Search ..... 347/12, 40, 15, 347/43, 42, 13, 68, 70, 71

(56) References Cited

U.S. PATENT DOCUMENTS 5,469,199 A 11/1995 Allen et al.
6,394,579 B1 5/2002 Boyd et al.
6,530,647 B2 * 3/2003 Kubota et al. ..... 347/43
6,742,866 B2 * 6/2004 Anderson et al. ..... 347/40

FOREIGN PATENT DOCUMENTS

EP 0914950 A2 5/1999
JP 2752843 B2 2/1998

* cited by examiner

*Primary Examiner*—Lamson Nguyen
(74) *Attorney, Agent, or Firm*—Sughrue Mion, PLLC

(57) ABSTRACT

A liquid ejection unit is constituted by including a flow path unit comprising a nozzle plate, a flow path forming plate and a sealing plate, the unit is attached to a head holder, at least two of first liquid ejection units are aligned in a direction of nozzle arrays, a second liquid ejection unit having a shorter length in the first direction than the first liquid ejection unit is arranged at a discontinuous portion of the nozzle arrays between the first liquid ejection units by being shifted from an alignment of the first ejection liquid units in a second direction and a single unit is formed by the liquid ejection units such that the nozzle arrays constitute a long nozzle group for ejecting the same kind of a liquid.

13 Claims, 18 Drawing Sheets

LIQUID EJECTION HEAD

BACKGROUND OF THE INVENTION

1. Field of the Invention

The present invention relates to a liquid ejection head setting a substantial length of a nozzle array for ejecting a liquid as long as possible.

2. Related Art

Although it is an effective method to prolong a length of a nozzle array orthogonal to a main scanning direction of an apparatus main body in order to increase printing speed, that is, to increase a printing area per unit time, a nozzle head cannot be used when malfunction is brought about even at a single nozzle opening in a fabrication procedure and therefore, a plurality of heads are aligned in a direction of a nozzle array to use.

However, by only arranging a plurality of ink ejection units A in a direction of aligning nozzles as shown by FIG. 17A, a dot nonforming area C is produced at an interval between nozzle arrays B of heads contiguous to each other.

In order to resolve such a problem, there has been proposed a recording head enabling long length formation excluding the above-described dot nonforming area C by arranging the ink ejection units A in a zigzag shape as is found also in Japanese Patent Publication No. 2752843 (FIG. 17B).

According thereto, although a long nozzle array without interruption in view from a sub scanning direction can be formed, there poses a problem that a size of simply adding widths of ink ejection units U is constituted, a dimension of an apparatus main body of a liquid ejection head in a main scanning direction is significantly enlarged, in order to make an ink ejection head effective, it is necessary to scan more than a width of a record medium and the apparatus is large-sized.

The invention has been carried out in view of such a situation and it is an object thereof to provide a liquid ejection head capable of realizing long length formation of a nozzle array while restraining an increase in a dimension of a liquid ejection head in a main scanning direction.

(1) In order to achieve the above-described object, the invention is constituted by a liquid ejection head constituting a liquid ejection unit by including a flow path unit formed by a laminated member including a nozzle plate formed with a nozzle array by aligning nozzle openings, a flow path forming plate formed with a pressure generating chamber communicating with the nozzle opening and a sealing plate for closing an opening of the pressure generating chamber, the liquid ejection unit being attached to a head holder for guiding a liquid from a liquid supply source, wherein at least two of first liquid ejection units are aligned in a first direction, a second liquid ejection unit having a length in the first direction shorter than a length in the first direction of the first liquid ejection unit is arranged at a discontinuous portion of the nozzle array present between the two first liquid ejection units in a state of being shifted from an alignment of the first liquid ejection unit in a second direction of an apparatus main body and a single unit is formed by the first liquid ejection units and the second liquid ejection unit such that the respective nozzle arrays constitutes a nozzle group for ejecting a same kind of a liquid.

That is, at least two of the first liquid ejection units are aligned in the first direction, the second liquid ejection unit having the length in the first direction shorter than the length in the first direction of the first liquid ejection unit is arranged at the discontinuous portion of the nozzle array present between the two first liquid ejection units in the state of being shifted from the alignment of the first liquid ejection unit in the second direction of the apparatus main body and the single unit is formed by the respective nozzle arrays to constitute the nozzle group for ejecting the same kind of the liquid by the first liquid ejection units and the second liquid ejection unit.

Thereby, the nozzle group for ejecting the same kind of the liquid is formed by the respective nozzle arrays of the first liquid ejection units and the second liquid ejection unit, a length of the effective nozzle array is apparently prolonged and ejection of the liquid to the fixed area is executed in a short period of time. Further, the first liquid ejection unit is a liquid ejection unit achieving an inherent ejection function and the second liquid ejection unit is for making the nozzle arrays of the two first liquid ejection units continuous in view of the function. Therefore, the first liquid ejection unit is assigned with a so-to-speak standard article having the most stabilized liquid ejection function, in contrast thereto, the second liquid ejection unit is provided with a length shorter than that of the first liquid ejection unit and therefore, the second liquid ejection unit per se is not provided with a factor of deteriorating the liquid ejection function and the long nozzle group having the stabilized liquid ejection function is provided for the first and the second liquid ejection units as a whole. Further, different kinds of liquids are ejected at the respective nozzle groups and therefore, by constituting a predetermined number of the nozzle groups, a number of kinds and a variety of liquid ejection can be carried out. When the above-described single unit is applied to the ink jet type recording apparatus, high speed formation of printing and a variety of print qualities are achieved.

(2) The invention is constituted such that the second liquid ejection units overlap each other in a direction orthogonal to the nozzle array in a state of shifting two of the single units in the first direction.

Thereby, the nozzle array of the second liquid ejection unit of other of the single units can be made proximate to the nozzle array of the first liquid ejection unit of one of the single units. Therefore, rows of the respective first liquid ejection units in the two single units can be made to be proximate to each other and shortening of a dimension of the liquid ejection head mounted with a plurality of the liquid ejection units in the second direction is realized. Specifically, although a unit space of an amount of four rows is needed when the two single units are not shifted as described above, a unit space of substantially an amount of three rows is constituted by the above-described alignment.

(3) According to the invention, an opposed unit is formed by opposingly arranging at least two of the single units in a state of being shifted from each other in the first direction to thereby arrange the respective second liquid ejection units in the respective single units substantially on a same row.

According thereto, the nozzle array of the second liquid ejection unit of other of the single units can mostly be made proximate to the nozzle array of the first liquid ejection unit of one of the single units.

Therefore, the rows of the respective first liquid ejection units in the two single units can be made to be mostly proximate to each other and shortening of the dimension of the liquid ejection head mounted with a plurality of the liquid ejection units in the second direction at a maximum is realized.

(4) According to the invention, a plurality of the opposed units are arranged.

According thereto, a number of the single units can be arranged while reducing the space in the second direction and therefore, sufficient kinds of liquids can be ejected from the prolonged nozzle groups by the compact liquid ejection head.

(5) According to the invention, a third liquid ejection unit for extending a total length of the nozzle group of the single unit by a predetermined length is incorporated in the single unit and the nozzle group is constituted by the respective nozzle arrays of the first, the second and the third liquid ejection units.

According thereto, the nozzle group can be set with a predetermined length by supplementing the length of the nozzle group pertinently by the third liquid ejection unit. Further, by making the length of the third liquid ejection unit in the first direction shorter than that of the first liquid ejection unit, the nozzle group can be prolonged while maintaining excellent function without deteriorating the liquid ejection function by the third liquid ejection unit.

(6) The invention is constituted such that the third liquid ejection unit includes a third liquid ejection unit arranged substantially at a row the same as the row of the second liquid ejection unit.

According thereto, the third liquid ejection unit can be arranged similar to "shifted arrangement" of the above-described second liquid ejection unit and therefore, even when the third liquid ejection unit is used, the liquid ejection head reducing the space in the second direction can be constituted.

(7) The invention is constituted such that the third liquid ejection unit includes the third liquid ejection unit arranged on the row substantially the same as the row of the second liquid ejection unit and includes a third liquid ejection unit arranged at a row substantially the same as a row of the first liquid ejection unit.

According thereto, the third liquid ejection unit arranged at the row the substantially the same as the row of the second liquid ejection unit achieves a function of extending the nozzle group in a state of being shifted from the first liquid ejection unit in the second direction. Further, the third liquid ejection unit arranged at the row substantially the same as the row of the first liquid ejection unit achieves a function of extending the nozzle group in a state of the row substantially the same as the row of the first liquid ejection unit by way of the third liquid ejection unit in the above-described shifted state. Therefore, the third liquid ejection unit extends the nozzle group in two kinds of modes of a state of being shifted in the second direction and a state of the row substantially the same as the row of the first liquid ejection unit and extension of the nozzle group having a high degree of freedom can be carried out by pertinently selecting the shifted state of the former and the state of the same row of the latter.

(8) The invention is constituted such that lengths of all of the third liquid ejection units and the second ejection unit in the first direction are substantially the same.

According thereto, all of the second and the third liquid ejection units can be made common as unit parts and therefore, the invention is advantageous in a reduction of a kind of parts and a reduction in cost.

(9) According to the invention, end portions of the nozzle groups between a plurality of the single units are arranged to align substantially on a straight line in the second direction of the apparatus main body by presence of the third liquid ejection unit.

According thereto, even when a shift is produced at the end portion of the nozzle group by arranging to shift the single unit formed by the first and the second liquid ejection units, the shift can be corrected to align substantially on the straight line by arranging the third liquid ejection unit. Therefore, liquid ejection without shift can be carried out among the plurality of the single units.

(10) The invention is constituted such that the nozzle arrays of the single units contiguous to each other in view from the second direction of the apparatus main body are arranged such that an opening pitch of the nozzle array of other of the single units is shifted from an opening pitch of the nozzle array of one of the single units and an amount of the shift is an amount of a half of the opening pitch.

According thereto, when two of the nozzle arrays in the shifted relationship are made to be compound in the second direction, the opening pitch becomes the substantially small opening pitch. Here, when the so-to-speak half pitch is constituted as described above in the nozzle array the opening pitch of which is reduced, liquid ejection per unit area to a member subjected to the liquid ejection is brought into an extremely dense state. On the other hand, when the half pitch is constituted as described above in the nozzle array the opening pitch of which is comparatively increased, by making the half pitch a multiplication of an integer of resolution, a number of times of strokes of the liquid ejection head in the second direction can be reduced. As advantages of these, in the ink jet type recording apparatus the former is effective in ensuring fine ejection quality and the latter can achieve shortening of printing time by being utilized in draft printing or the like.

(11) According to the invention, the head holder is provided with a projected portion for positioning the first liquid ejection unit, the second liquid ejection unit, the third liquid ejection unit or the like.

According thereto, by attaching the respective liquid ejection units to the head holder by being brought into contact with the projected portion for positioning, the single unit and the nozzle group can be formed with high accuracy and excellent liquid ejection is achieved from the prolonged nozzle group. Further, stabilized liquid ejection is achieved by the opposed unit opposing the single units as a whole. Further, even when the nozzle arrays of the single units contiguous to each other are shifted to make a half pitch of the nozzle openings as described above, the highly accurate opening pitch can be ensured.

(12) According to the invention, the head holder is provided with an outer peripheral wall member for positioning the first liquid ejection unit, the second liquid ejection unit, the third liquid ejection unit or the like.

According thereto, by attaching the respective liquid ejection units to the head holder by being brought into contact with the outer peripheral wall member for positioning, the single unit and the nozzle group can be formed with high accuracy and excellent liquid ejection is achieved from the prolonged nozzle group. Further, stabilized liquid ejection is achieved in the opposed unit opposing the single units as a whole. Further, even when the nozzle arrays of the single units contiguous to each other are shifted to constitute the half pitch of the nozzle openings, the pitch of the highly accurate nozzle opening can be ensured.

(13) The invention is constituted such that the first liquid ejection unit, the second liquid ejection unit, the third liquid ejection unit or the like is constituted by bonding the flow path unit to the head case, a pressure generating element for producing a pressure variation in the pressure generating chamber is constituted by a piezoelectric oscillator of a vertical oscillation mode, the piezoelectric oscillator is fixed to a fixing board, the piezoelectric oscillator and the fixing board are inserted into a containing chamber provided at the head case in a state of corresponding to the pressure generating chamber and the fixing board is brought into a fixed state at inside of the containing chamber.

According thereto, the piezoelectric oscillator per se of the vertical oscillation mode is excellent in operational response to the applied drive signal, further, driving displacement output in the vertical direction is provided and therefore, the liquid in the pressure generating chamber is pressurized to correspond to the drive signal and liquid ejection from the nozzle array is firmly carried out with high reliability. The respective first, second and third liquid ejection units can be made to function by the piezoelectric oscillator having such a property and therefore, liquid ejection from a series of the nozzle groups can excellently be achieved in any of the nozzle arrays. Therefore, an amount of the liquid droplet and accuracy of impacting the liquid droplet can be confined to levels which are not problematic in view of practice over a total area of the length of the prolonged nozzle group.

DETAILED DESCRIPTION OF THE PREFERRED EMBODIMENTS

Next, an explanation will be given of an ink jet type recording apparatus which is one application field of a liquid ejection head according to the invention.

Figure 1:
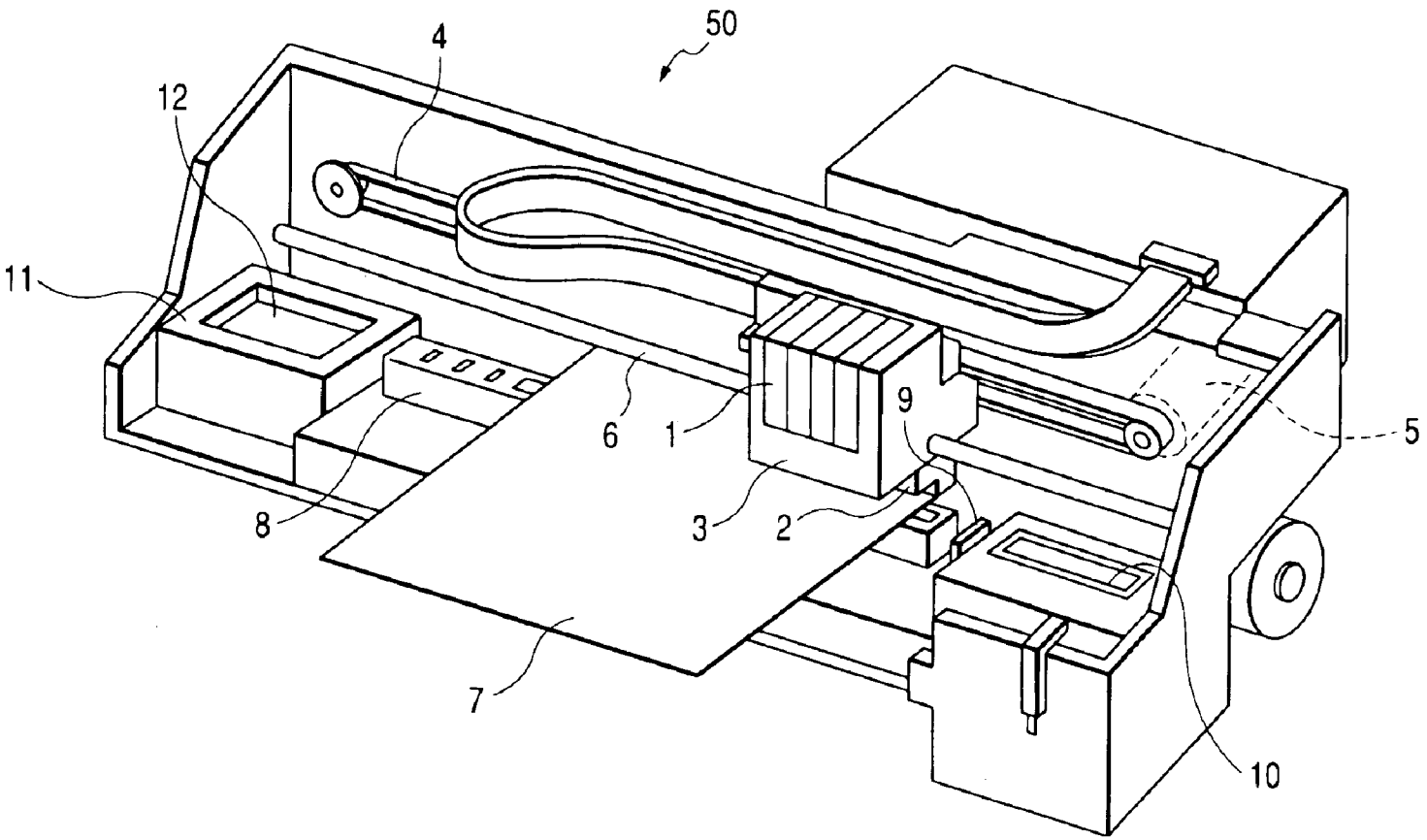
FIG. 1 is a perspective view showing an embodiment of an ink jet type recording apparatus to which an ink ejection head according to the invention is applied as an ink jet recording head.

In FIG. 1, an ink jet type recording apparatus 50 is provided with a carriage 3 mounted with an ink cartridge 1 and attached with a liquid ejection head according to the invention as a recording head 2.

The carriage is connected to a stepping motor 5 via a timing belt 4 and reciprocally moved in a paper width direction (hereinafter, also referred to as "main scanning direction" corresponding to the second direction of the invention) of a record medium 7 which is record paper by being guided by a guide bar 6. The carriage 3 is formed in a shape of a box an upper portion of which is opened and functions also as a holder for containing an ink cartridge and a face thereof (lower face in this example) opposed to the record medium 7 is attached with a nozzle forming face of the recording head 2 to expose.

The recording head 2 is supplied with ink from the ink cartridge 1 and prints an image or a character on the record medium 7 by a dot matrix by delivering ink droplets onto an upper face of the record medium 7 by reciprocal movement in the main scanning direction of the carriage 3.

A long guide member 8 extended in the main scanning direction of the recording head 2 is arranged to guide movement of the record medium 7. A wiper apparatus 9 for cleaning a nozzle plate 17 (mentioned later) of the recording head 2 and a capping apparatus 10 for supplying negative pressure for preventing a nozzle opening portion from being dried and resolving clogging thereof are arranged contiguous to one end side of the guide member 8. Further, a flushing box 11 having a flushing opening portion 12 for receiving ink droplets delivered from the recording head 2 is arranged contiguous to other end side of the guide member 8.

Figure 2:
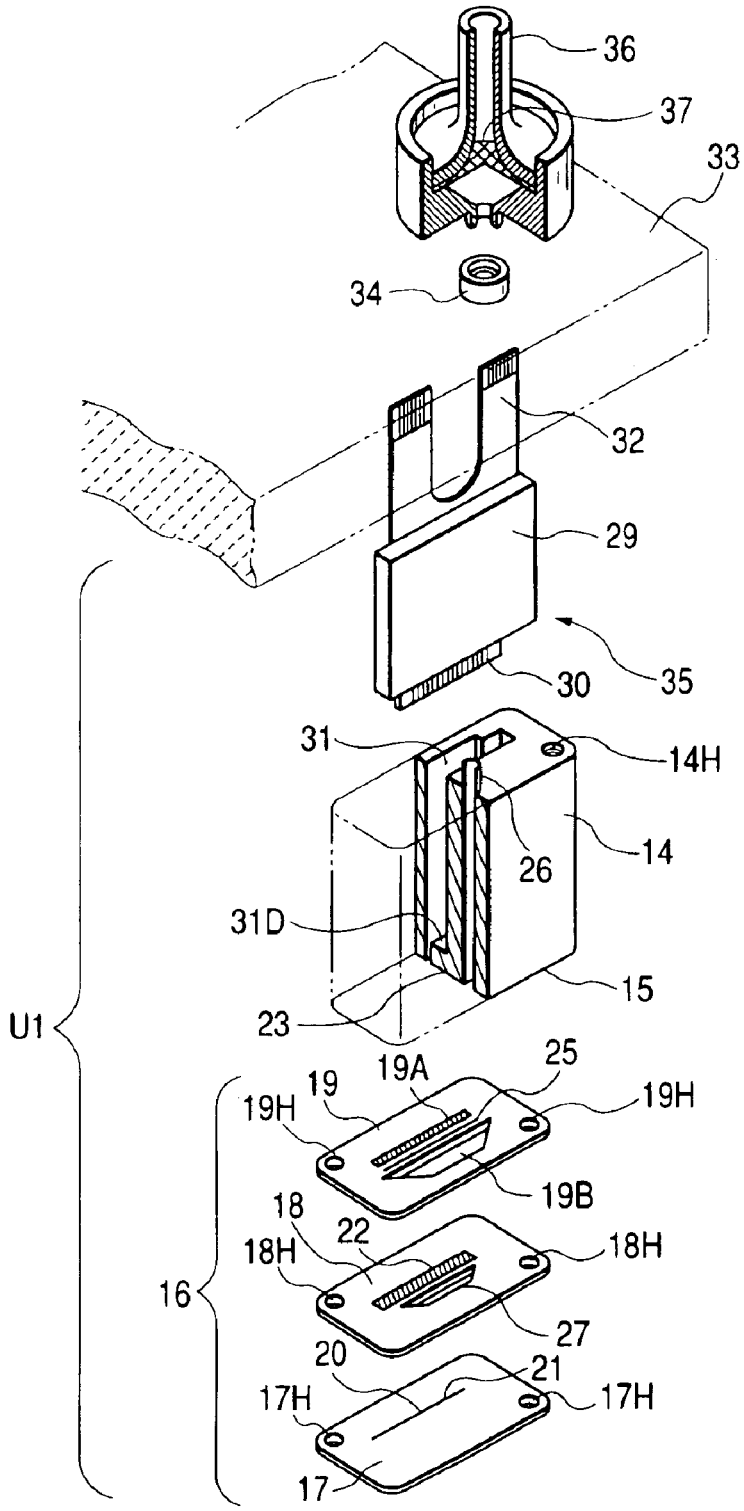
FIG. 2 is a disassembled perspective view showing a liquid ejection head according to the embodiment of the invention.
Figure 3:
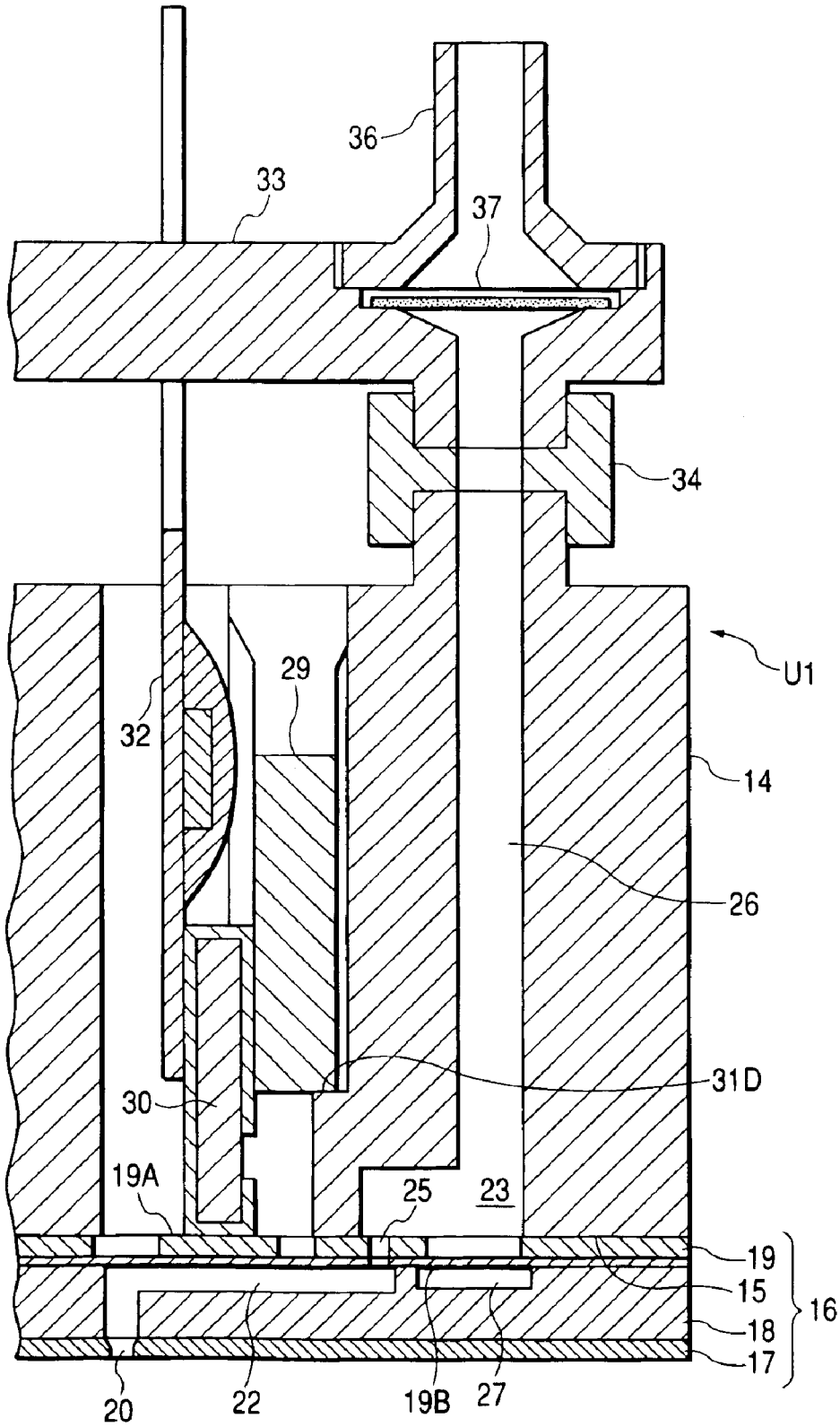
FIG. 3 is a sectional view showing a sectional structure of the liquid ejection head.

FIG. 2 and FIG. 3 respectively show an embodiment of a first ink ejection unit U1 constituting the liquid ejection head according to the invention and the first ink ejection unit U1 is constituted by a head case 14 and a flow path unit 16 fixedly attached to a unit fixing face 15 of the head case 14 by an adhering agent or the like. The flow path unit 16 is constituted by laminating to fix the nozzle plate 17, a flow path forming plate 18 and a sealing plate 19 exemplified in a mode of an oscillation plate.

The nozzle plate 17 comprises a stainless steel plate and a number of nozzle openings 20 thereof form a nozzle array 21 by being arranged in a row-like shape by a density substantially coinciding with a liquid droplet density on a liquid droplet receptor, or in this embodiment, a dot density to be formed at a recorded member. The flow path forming plate 18 comprises a silicon single crystal plate which is a material plate and a pressure generating chamber 22 communicating with the nozzle opening 20 and a recess portion for damper 27 communicating with the atmosphere (not illustrated) are formed by anisotropic etching. An ink storing chamber 23 communicating with an ink supply pipe 26 and formed by a volume larger than that of the pressure generating chamber 22 is communicated with respectives of the pressure generating chambers 22 via ink introducing ports 25 opened at the sealing plate 19.

The oscillation plate 19 is laminated with a resin film and a stainless steel plate and formed with an island portion 19A a surrounding of which is constituted only by the resin film at a rear face of a portion in correspondence with each pressure generating chamber 22. Further, notation 19B designates a compliance portion constituted only by the resin film in a shape substantially the same as that of the ink storing chamber 23.

The head case 14 is an ejection-molded product of a thermosetting rein or a thermoplastic resin and is opened with the ink supply pipe 26 for introducing ink to the ink storing chamber 23. Further, at a portion of the flow path forming plate 18 in correspondence with the ink storing chamber 23, the recess portion for damper 27 having a shape substantially coinciding with the shape of the ink storing chamber 23 is formed.

Numeral 29 designates a fixing board fixed with a piezoelectric oscillator 30 and numeral 31 designates a containing chamber for containing a piezoelectric oscillator unit 35 constituted by fixing the piezoelectric oscillator 30 to the fixing board 29. The piezoelectric oscillator 30 is fixed to the fixing board 29 and the piezoelectric oscillator 30 and the fixing board 29 are inserted into the containing chamber 31 provided at the head case 14 in a state of corresponding to the pressure generating chamber 22 and the fixing board 29 is brought into a fixed state at inside of the containing chamber 29.

By the above-described constitution, the piezoelectric oscillator 30 per se in a vertical oscillation mode is excellent in operational response to an applied drive signal, further, a drive displacement output in a vertical direction is provided and therefore, ink at the pressure generating chamber 22 is pressurized to correspond to the drive signal and ink droplets are delivered from the nozzle array 21 firmly with high reliability. Respective first, second and third ink ejection units are made to function by the piezoelectric oscillator 30 having such a property and therefore, delivery of ink droplets from a series of nozzle groups 38 is excellently achieved at any of the nozzle groups 38. Therefore, even when nonuniformity of delivery is brought about over a total area of the length of the nozzle group 38 which is prolonged, the nonuniformity can be confined to a level by which actual damage is not caused substantially.

The first ink ejection unit U1 having the above-described constitution is integrated, for example, as follows. That is, first, the unit fixing face 15 of the head case 14 is coated with an adhering agent such that the adhering agent does not flow to the ink supply pipe 26 or the containing chamber 31 or pasted with an adhering sheet formed by being punched in a predetermined shape or the like, and the flow path unit 16 integrated by being bonded previously by an adhering agent or the like is mounted thereon. Successively, the flow path unit 16 and the head case 14 are fixedly attached to each other by being heated at temperature of about 40 through 100° C. and being pressed or the like as necessary.

Meanwhile, the piezoelectric oscillator unit 35 produced by fixing the piezoelectric oscillator 30 to the fixing board 29 is prepared and a front end of the piezoelectric oscillator 30 is coated with an adhering agent. Next, the head case 14 is reverted such that the flow path unit 16 is disposed on the lower side and the piezoelectric oscillator unit 35 is contained in the containing chamber 31 to fixedly adhered thereto. Under the state, the front end of the piezoelectric oscillator 30 is fixedly adhered to the oscillation plate 19 of the flow path unit 16 and the fixing board 29 is finally fixed to the head case 14 to thereby finish the first ink ejection unit U1.

According to the first ink ejection unit U1, the piezoelectric oscillator 30 is elongated and contracted in a longitudinal direction by inputting the drive signal generated by a driving circuit (not illustrated) to the piezoelectric oscillator 30 via a flexible cable 32. By elongation and contraction of the piezoelectric oscillator 30, the island portion 19A of the oscillation plate 19 is oscillated to thereby change pressure at inside of the pressure generating chamber 22 and ink at inside of the pressure generating chamber 22 is delivered from the nozzle opening 20 as ink droplets.

Figure 18:
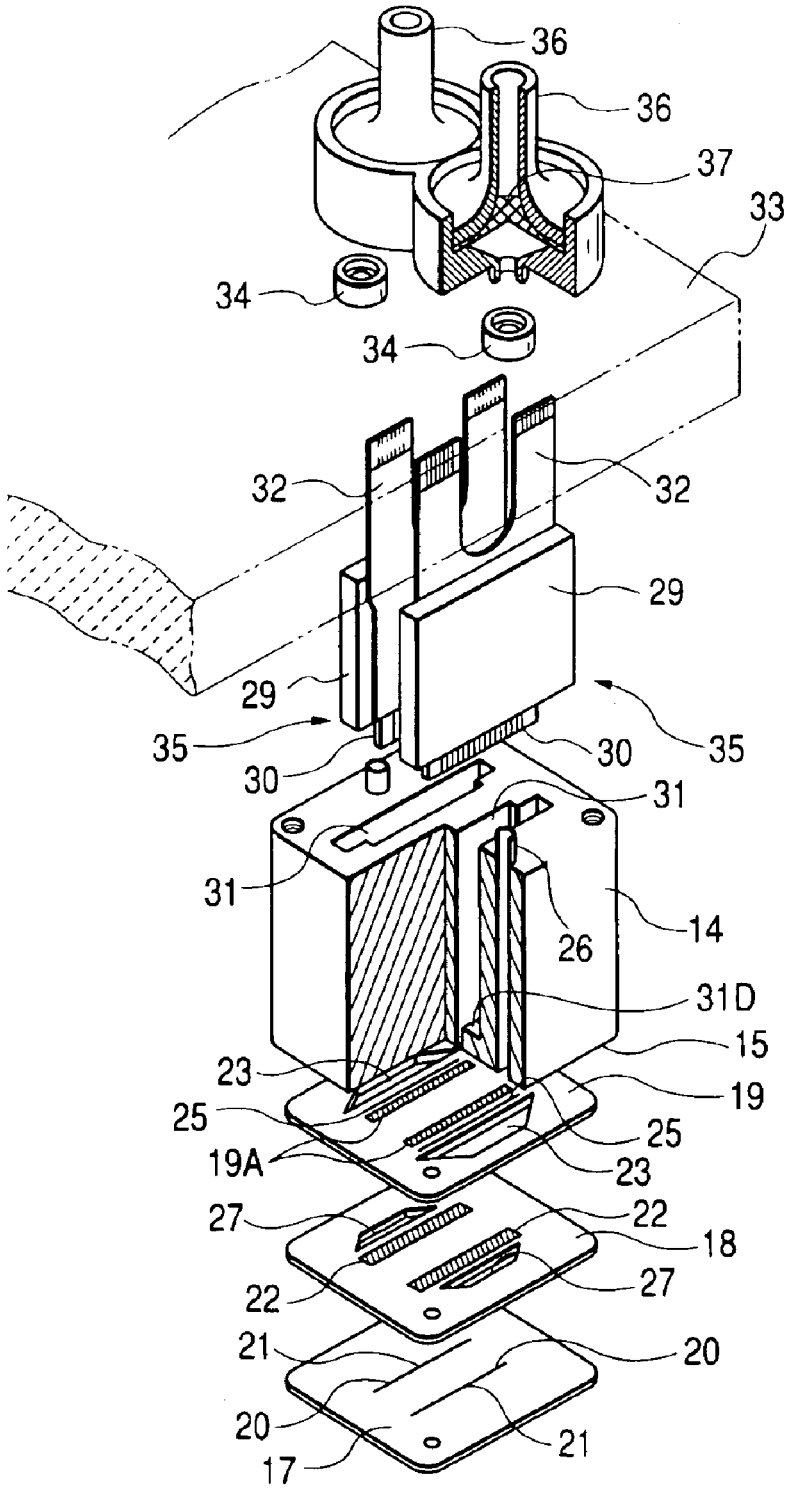
FIG. 18 is an exploded view showing a structure that the nozzle arrays are provided in double.

Although the first ink ejection unit U1 is constituted to deliver liquid droplets at a predetermined pitch by a single piece of the nozzle array 21, similar operation is achieved by doubling the pitch of the respective nozzle openings as shown in FIG. 18, arranging a second nozzle array to dispose on sides of the nozzle openings and forming two rows of the nozzle arrays 21 at the same ink ejection unit U1.

The first ink ejection unit U1 is attached to a head holder 33 via a joint member 34 or the like. Although the head holder 33 is formed in a shape of a number of recesses and projections in order to provide various functions, basically, the shape is a mode in a plate-like shape as shown by the respective drawings. The head holder 33 is attached with an ink connecting portion 36 in a shape of a pipe. The ink connecting portion 36 achieves a function of introducing ink from an ink supply source (ink cartridge) and when the head holder 33 is mounted with the ink cartridge, the ink connecting portion 36 constitutes an ink supply needle (not illustrated) to be brought into a state of being pierced into the ink cartridge 1.

A filter 37 is arranged on the downstream side of the ink connecting portion 36 to catch an impurity or the like in ink to prevent from flowing down to the ink supply pipe 26.

An order of integrating the first ink ejection unit U1 is as described above and a reference hole is utilized in the integration. Notation 17H designates a reference hole of the nozzle plate 17, notation 18H designates a reference hole of the flow path forming plate 18, notation 19H designates a reference hole of the sealing plate 19 and notation 14H designates a reference hole of the head case 14, The reference holes 17H, 18H and 19H are used for positioning by inserting positioning pins (not illustrated) when the flow path unit 16 is finished by laminating to fix the nozzle plate 17, the flow path forming plate 18 and the sealing plate 19 in this order.

Further, also when the flow path unit 16 is bonded to the unit fixing face 15 of the head case 14, the both members are integrated by making the reference holes 17H, 18H and 19H brought in a communicated state in the flow path unit 16 coincide with the reference hole 14H on the side of the head case 14 and using the positioning pins (not illustrated). Further, also when the first ink ejection unit U1 is fixed to the head holder 33, the reference hole 14H can be utilized. At this occasion, the reference hole 14H can also be utilized in normally setting a positional relationship between a plurality of the first ink ejection units U1 or between second and third ink ejection units U2 and U3, mentioned later, by making a reference hole or a reference pin (not illustrated) on the side of the head holder 33 coincide with the reference hole 14H of the head case 14.

Figure 4:
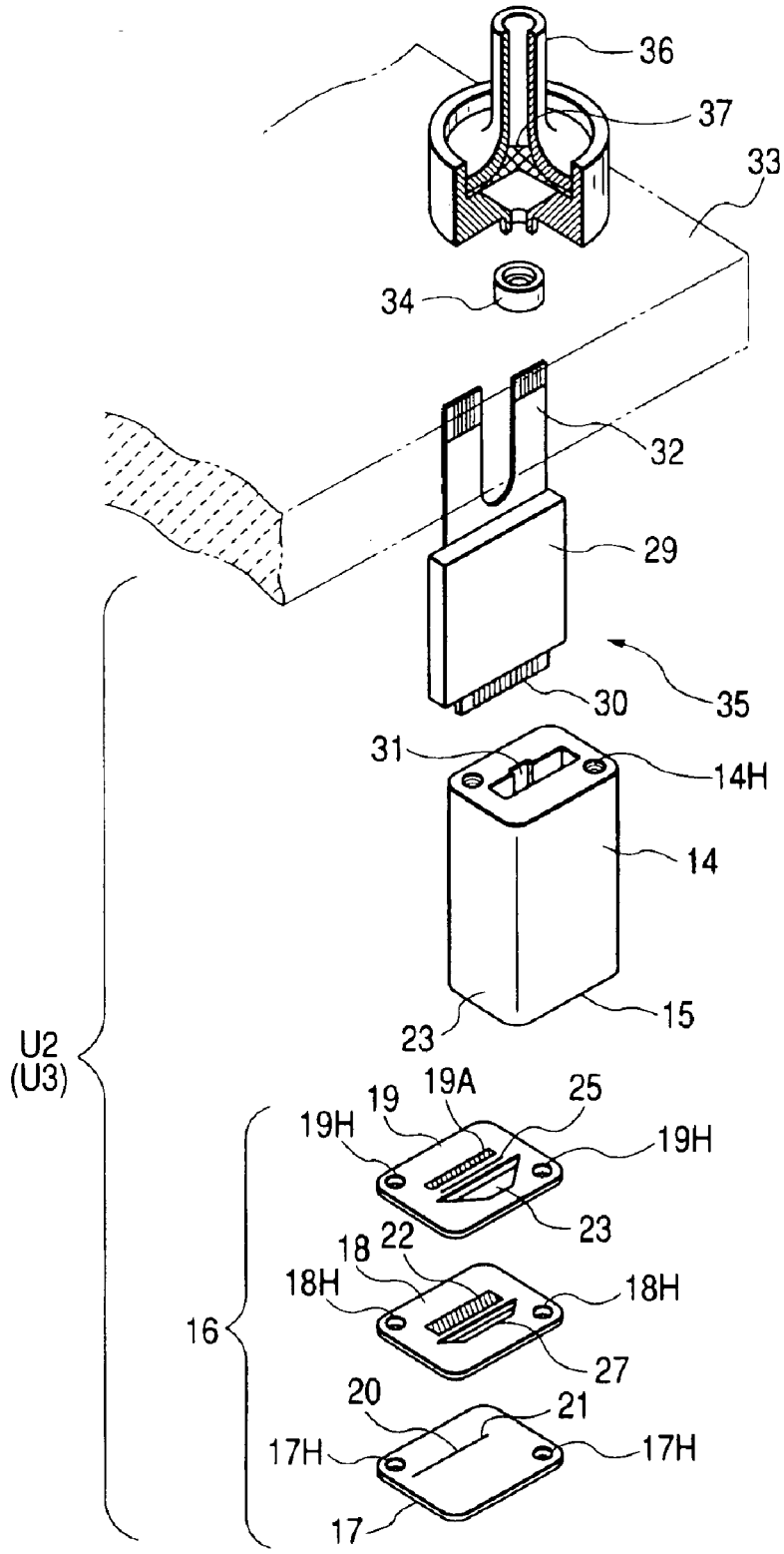
FIG. 4 is a disassembled perspective view showing a second ink ejection unit and a third ink ejection unit shortening a length in a direction of a nozzle array.

FIG. 4 shows a second ink ejection unit U2 for constituting a liquid ejection head according to the invention in cooperation with the first ink ejection unit U1 and a basic structure thereof is constituted by an inner structure the same as that of the first ink ejection unit U1 other than a structure thereof in which a length thereof in the direction of the nozzle array 21 (herein under referred as "nozzle array direction" corresponding to the first direction of the invention) is made shorter than that of the first ink ejection unit U1. Further, also a third ink ejection unit U3 is constituted similar to the second ink ejection unit U2.

Figure 5A:
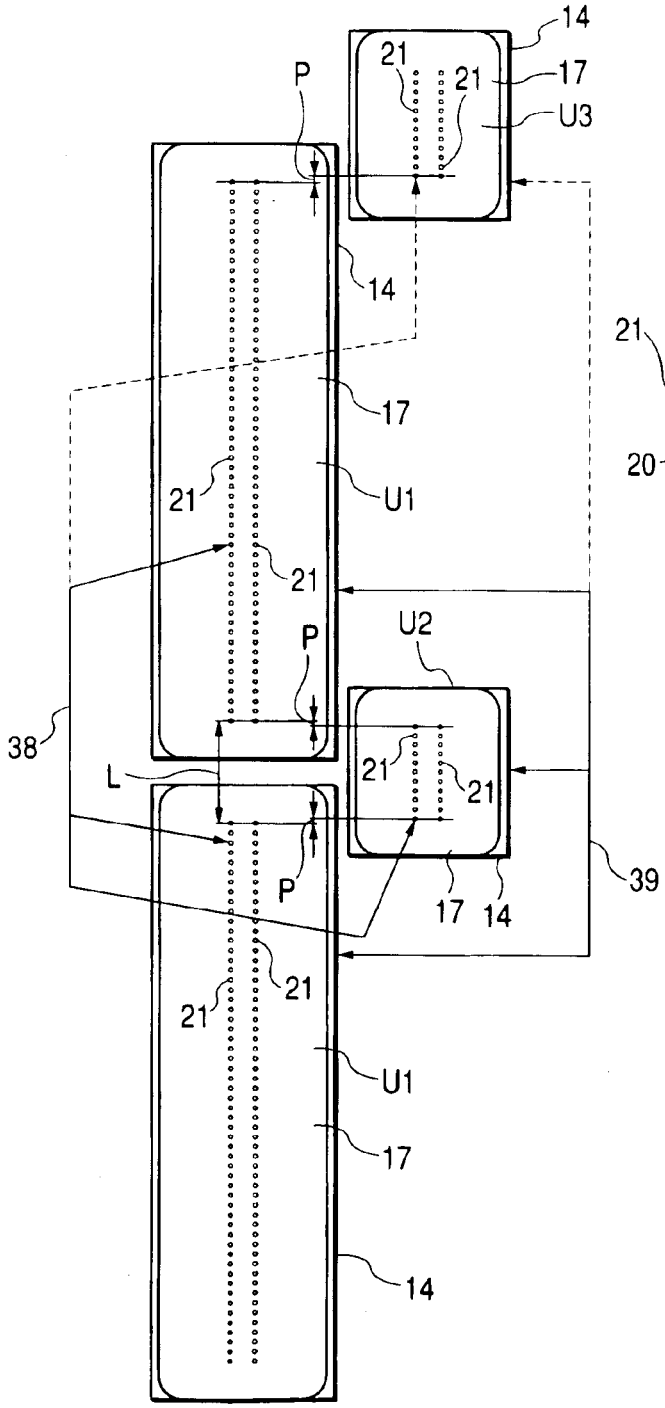
FIG. 5A is a plane view showing an arrangement of respective ink ejection units and FIG. 5B is a plane view showing a state of arranging an effective nozzle opening.
Figure 5B:
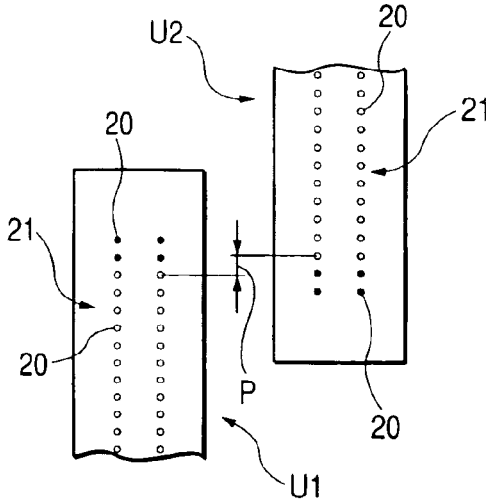

FIGS. 5A and 5B are plane views showing an embodiment of the liquid ejection head according to the invention constituted by using the first ink ejection unit U1, the second ink ejection unit U2 and the third ink ejection unit U3 and at least two of the first ink ejection units U1 are arranged such that the respective nozzle arrays 21 are disposed on the same line and the second ink ejection unit U2 is arranged at a discontinuous portion of the nozzle openings produced between two of the units U1 and at a position shifted in the main scanning direction.

That is, the second ink ejection unit U2 is arranged such that a pitch of the nozzles is the same as that of the first ejection unit U1.

Thereby, the nozzle arrays 21 of two of the first ink ejection units U1 and the nozzle array 21 of the second ink ejection unit U2 are continuous in the nozzle array direction as a whole although the position of the second ink ejection head U2 is shifted by a prescribed amount in the main scanning direction and therefore, by shifting timings of the first ink ejection head U1 and the second ink ejection head U2 for ejecting ink droplets, "nozzle group 38" capable of ejecting ink of the same color can be formed continuously on the same line. Further, the first ink ejection units U1 and the second ink ejection unit U2 constituting such a nozzle group is referred to as "single unit 39".

In order to prolong a total length of the nozzle group 38 to a predetermined length, the third ink ejection unit U3 is aligned in a state of being incorporated to the single unit 39.

That is, the third ink ejection unit U3 shown in FIG. 5A is continuous to a nozzle at an upper end of the first ink ejection unit U1 arranged on an upper side of the drawing and arranged by being shifted from the first ink ejection unit U1 by a prescribed amount in the main scanning direction similar to the second ink ejection unit U2. That is, the nozzle arrays of the second ink ejection unit U2 and the third ink ejection U3 are arranged to respectively dispose on the same line.

Further, the nozzle array 21 of the third ink ejection unit U3 delivers ink of the same color continuously to the nozzle array 21 of the first ink ejection unit U1 and thereby, the respective nozzle arrays 21 of the first, the second and the third ink ejection units U1, U2 and U3 constitute a series thereof to form the nozzle group 38.

When a state of end portions of the nozzle arrays 21 continuous to each other in view of the function is enlarged, there is a case as shown by FIG. 5B. That is, there is conceivable a mode of use in which with regard to the nozzle opening 20 at a vicinity of the end portion of the nozzle array 21, although the nozzle opening 20 and the pressure generating chamber 22 in correspondence therewith are present, since such a nozzle is disposed at the end portion, in order to stabilize a delivery characteristic thereof, one or two pieces of the nozzle openings 20 designated by black circles in the drawing are not used for delivery of ink droplets, that is, are not supplied with the drive signals.

Therefore, the nozzle array 21 on the side of the first ink ejection unit U1 and the nozzle array 21 on the side of the second ink ejection unit U2 can constitute the nozzle group 38 avoiding instability of ejecting ink of the nozzle opening 20 at the end portion of each of the ink ejection units by a nozzle array excluding the nozzle opening 20 designated by the black circle and constituted only by the nozzle opening 20 which is effective in delivering ink droplets although the nozzle arrays 21 are disposed at intervals of an amount of a pitch of the nozzle openings 20.

Such a consideration is applicable also to a case in which, for example, quarters of the nozzle arrays of two of the first ink ejection units U1 are not used and a nozzle group having a necessary length is formed by prolonging the second ink ejection unit U2 instead thereof as other application example. Thereby, there can be formed a nozzle group having a necessary long length by using the first ink ejection units U1 having the most stabilized ejection function, by dealing therewith by only slightly prolonging the length of the second ink ejection unit U2 and only by three of the units U1 and U2.

Therefore, a series of the respective nozzle arrays 21 of the first ink ejection units U1 and the second ink ejection unit U2 forms a single group of the nozzle group 38 for delivering the same color ink, the length of the nozzle array is prolonged apparently and delivery of ink droplets to a fixed area can be carried out in a short period of time. Further, the first ink ejection unit U1 is an ink ejection unit for achieving to deliver ink droplets inherently and the second ink ejection unit U2 makes the nozzle arrays 21 of the first ink ejection units U1 continuous in view of the function. Therefore, the first ink ejection unit U1 is assigned with a so-to-speak standard article having a length by which the ink droplet delivery function is mostly stabilized and in contrast thereto, the second ejection unit U2 is provided with a length shorter than that of the first ink ejection unit U1 and therefore, the second ink ejection unit U2 per se is not provided with a factor of deteriorating the ink droplet delivery function, the first and the second ink ejection units U1 and U2 are provided with the long nozzle group 38 having the stabilized ink droplet delivery function as a whole and shortening of printing time is realized.

Figure 6A:
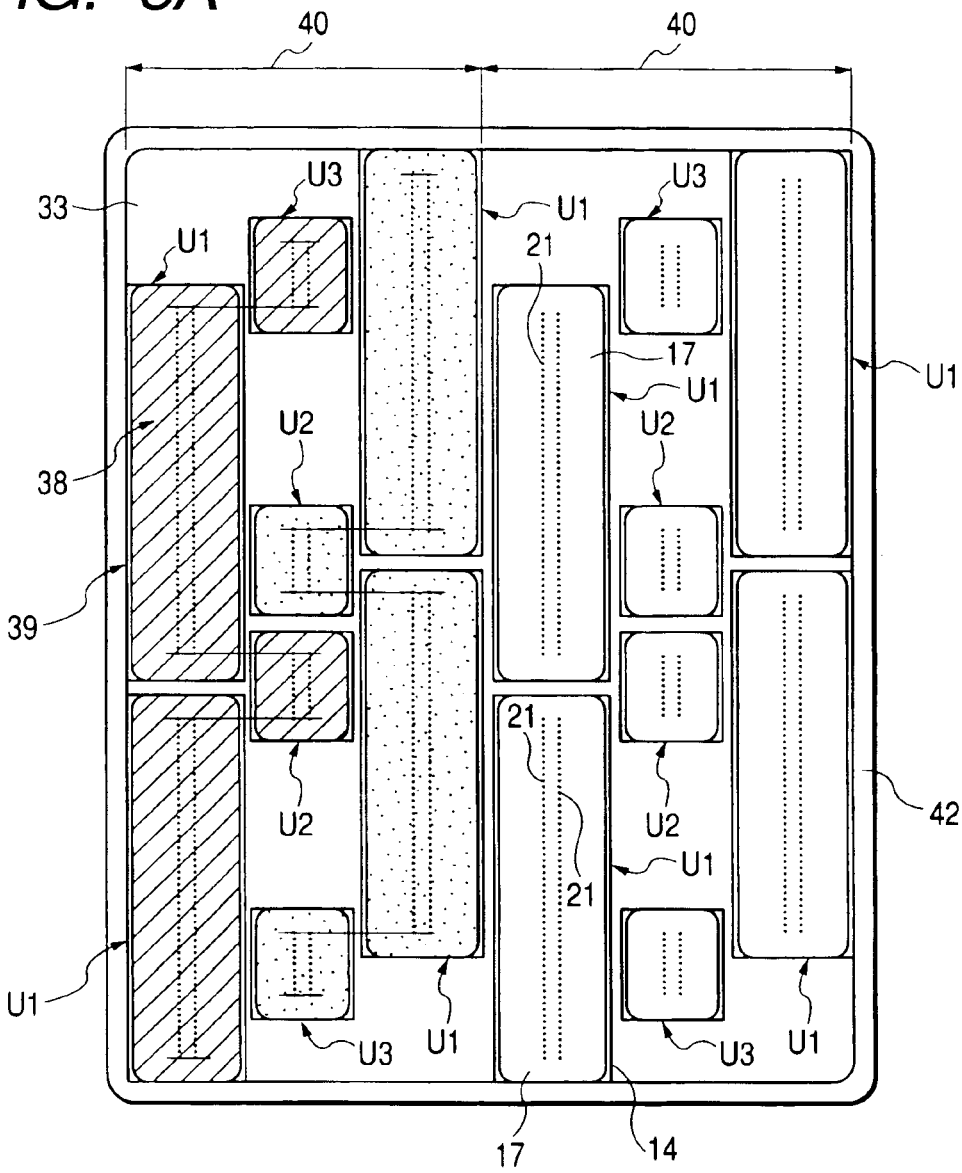
FIG. 6A is a plane view showing a state of attaching a single unit to a head holder and FIG. 6B is a plane view showing a relationship between pitches of nozzle openings of nozzle groups contiguous to each other.

In FIG. 6A, "opposed unit 40" is formed by opposing the single units 39 shown in FIG. 5A and shifting either one of the single units 39 in the nozzle array direction. Two of the opposed units 40 are attached to the head holder 33 in such a state of the opposed units 40. In the respective ink ejection units U1, U2 and U3, in order to facilitate understanding in FIG. 6A, one of the opposed single units 39 is provided with hatching and other thereof is provided with mat matrix.

There is brought about a state in which the nozzle array 21 of the second ink ejection unit U2 of other of the single units 39 is made proximate to the nozzle array 21 of the first ink ejection unit U1 of one of the single units 39. The second ejection units U2 of the two single units 39 are brought into a state of being duplicated in the main scanning direction of the apparatus main body 50 and therefore, the nozzle array 21 of the second ink ejection unit U2 of other of the single units 39 can be made proximate to the nozzle array 21 of the first ink ejection unit U1 of one of the single units 39.

Therefore, rows of the respective first ink ejection units U1 in the two single units 39 can be made to be proximate to each other and a dimension (width dimension) in the main scanning direction of the ink ejection head 2 mounted with the plurality of ink ejection units U1, U2 and U3 can be shortened. Specifically, although when the two single units 39 are not shifted from each other as described above, an amount of four rows of unit spaces are needed, an amount of two rows of the long nozzle groups can be arranged substantially by an amount of three rows of the unit spaces by the above-described arrangement.

Since the plurality of the single units 39 are arranged, a number of the single units 39 can be arranged while reducing the space in the main scanning direction and therefore, the compact ink ejection head 2 is provided, a plurality of kinds of inks can be ejected by the elongated nozzle groups 33 and not only high speed formation of printing but also variety formation of printing such as color formation can be realized.

Further, the nozzle group 38 is formed in a state of incorporating the third ink ejection unit U3 to the single unit 39 to add to the first ink ejecting unit U1 and the second ink ejection unit U2 and therefore, the nozzle group 38 can be set to a predetermined length by supplementing the length of the nozzle group 38 pertinently by the third ink ejection unit U3.

As shown by FIG. 5A, the third ink ejection unit U3 arranged at a row substantially the same as that of the second ink ejection unit U2 is included and therefore, when the single units 39 including the third ink ejection units U3 are opposed to each other, the third ink ejection units U3 can be arranged by applying "shifted arrangement" for arranging the second ink ejection unit U2 to shift from the first ink ejection unit U1 in the main scanning direction and in the nozzle array direction and therefore, even when the third ink ejection units U3 are added, there can be constituted the ink ejection head 2 reducing the width in the main scanning direction and reducing a dead space and aligning the nozzle arrays at a high density.

Figure 6B:
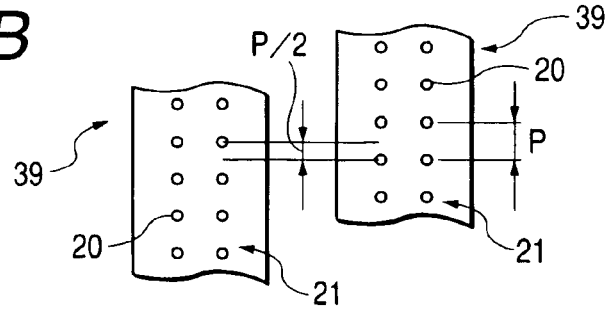

Further, as shown by FIG. 6B, the nozzle arrays 21 of the single units 39 contiguous in the main scanning direction of the apparatus main body are arranged such that in view from the sub scanning direction (direction of extending nozzle array), the opening pitch P of the nozzle array 21 of other of the single units 39 is shifted from the opening pitch P of the nozzle array 21 of one of the single units 39 by a half of the opening pitch P. Thereby, when the same kind of ink droplets are delivered by commonly using two of the nozzle arrays 21, dots can be formed by a density of a half of the pitch P of aligning the nozzle openings of each of the ink ejection units, that is, by a double density.

Here, in the nozzle arrays 21 reducing the opening pitch P, when a so-to-speak half pitch is constituted as described above, delivery of ink droplets per unit area to the record medium 7 is brought into an extremely dense state.

On the other hand, when the above-described half pitch is constituted in the nozzle arrays 21 comparatively increasing the opening pitch P, by constituting the half pitch by a multiplication of an integer of resolution, a number of times of reciprocal movement of the ink ejection head 2 in the main scanning direction can be reduced. The former of the advantages is effective in ensuring fine printing quality and the latter thereof is effective in draft printing since printing speed can be doubled.

Figure 7:
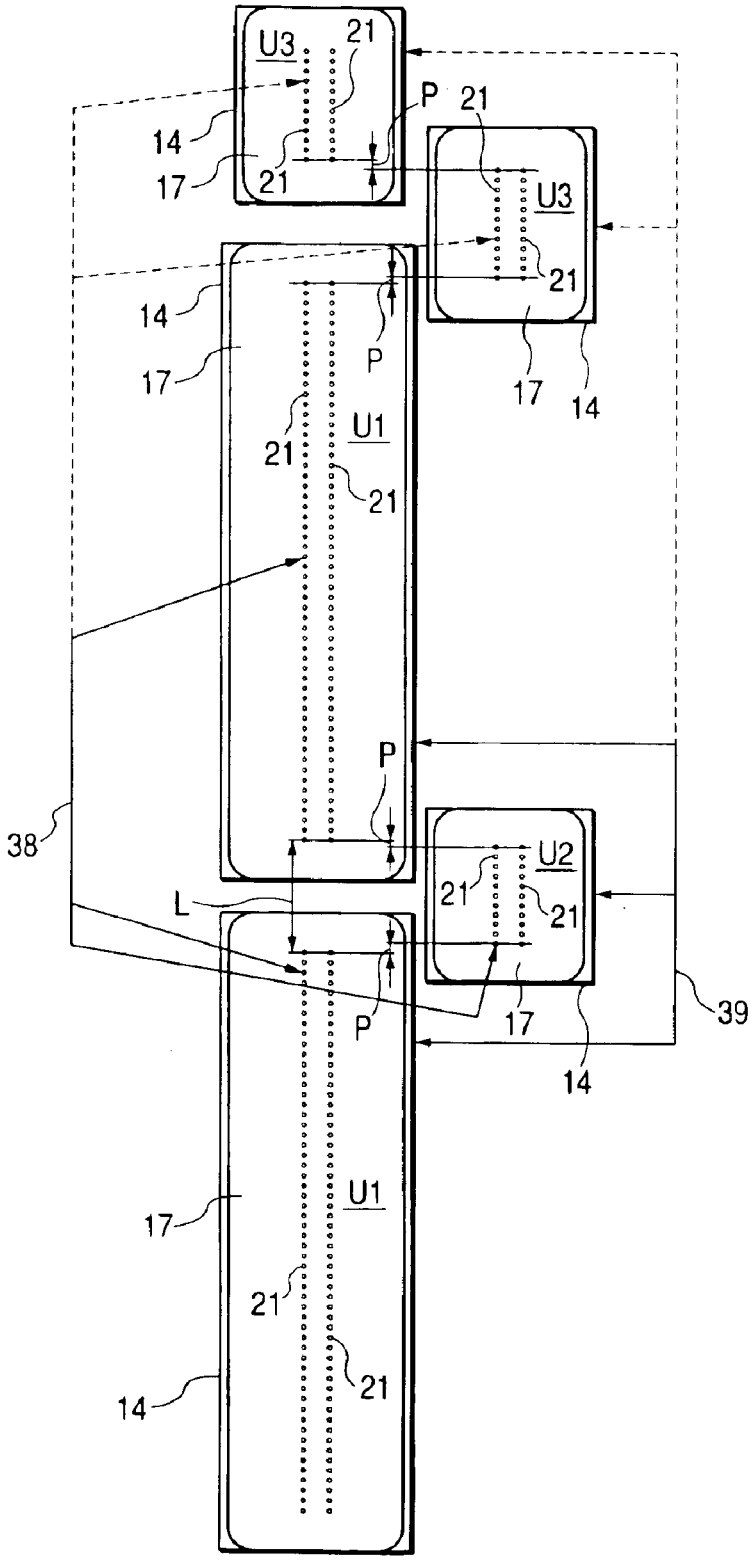
FIG. 7 shows a second embodiment of a liquid ejection head according to the invention and is a plane view showing an alignment of respective ink ejection units.
Figure 8:
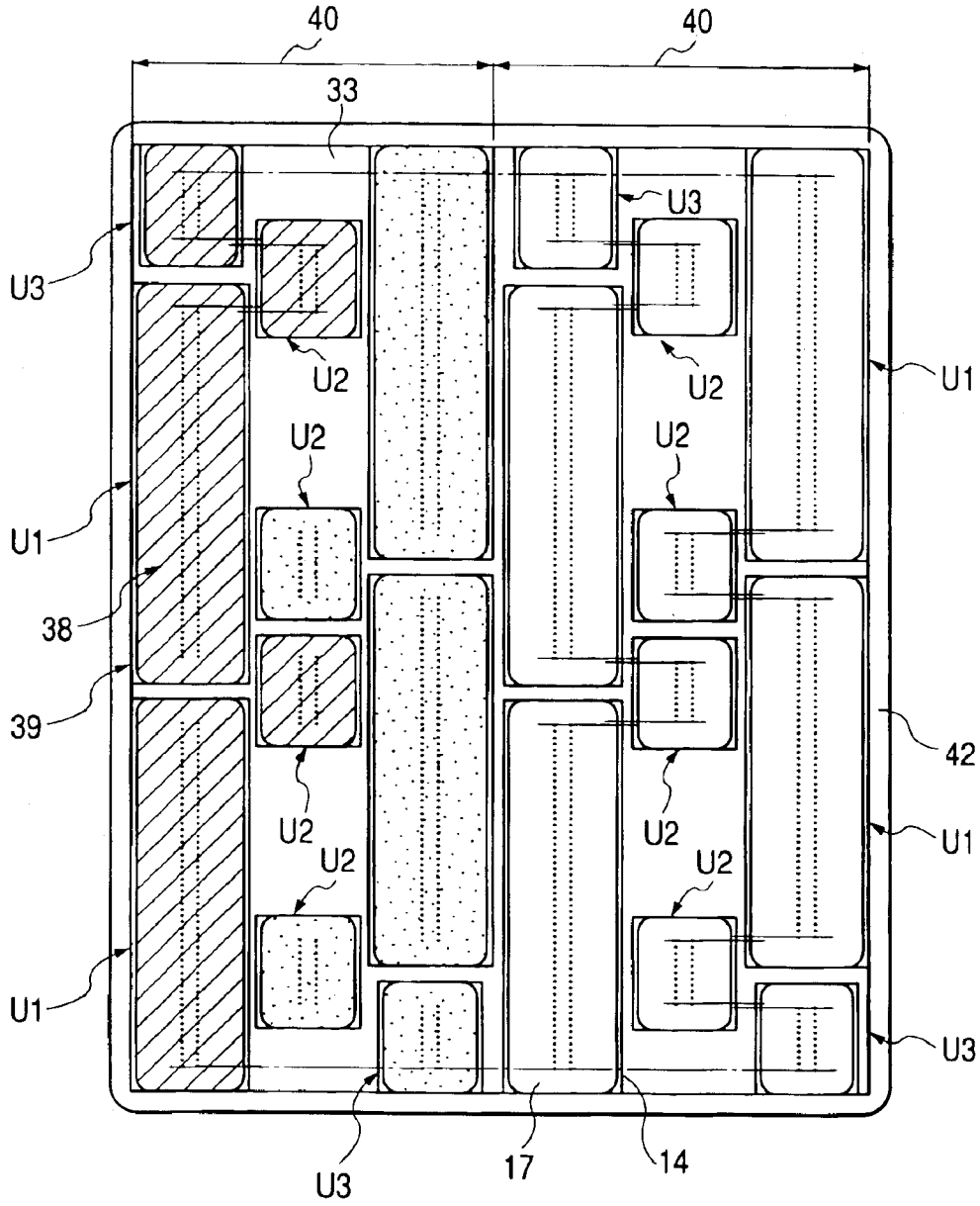
FIG. 8 is a plane view showing an embodiment of a liquid ejection head constituted by attaching the respective ejection units shown in FIG. 7 to a head holder as a mode of aligning nozzle arrays.

FIG. 7 and FIG. 8 show a second embodiment of the liquid ejection head according to the invention.

According to the embodiment, the length of the nozzle group 38 is prolonged by connecting two of the third ink ejection units U3 further to the single unit 39 comprising the first ink ejection units U1 and the second ink ejection unit U2.

That is, one of the third ink ejection units U3 is aligned at a position on the row substantially the same as that of the second ejection unit U2 and other of the third ink ejection units U3 is aligned at a position on the row substantially the same as that of the first ink ejection unit U1. Therefore, the third ink ejection unit U3 shifted in the main scanning direction achieves the function of making the respective nozzle arrays 21 of the third ink ejection unit U3 on the row the same as that of the first ink ejection unit U1 in the sub scanning direction.

Further, two of the third ink ejection units U3 are constituted such that a length thereof in a nozzle array direction is substantially the same as that of the second ink ejection unit U2.

Further, according to an embodiment shown in FIG. 8, the opposed unit 40 is formed by opposing the single units 39 shown in FIG. 7 to constitute point symmetry, that is, symmetry in the vertical direction and the horizontal direction and the ejection head is constituted by arranging two of the opposed units 40 in parallel with the main scanning direction.

The nozzle array 21 of the third ink jet unit U3 arranged at an end portion of one of the single units 39 and the nozzle array 21 of the first ink ejection unit U1 arranged at an end portion of other of the single units 39 are arranged such that end portions of the respective nozzle arrays 21 are aligned substantially on a straight line in the main scanning line of the apparatus main body. That is, by presence of the third ink ejection unit U3, end portions of the nozzle groups 38 between a plurality of the single units 39 are aligned by being aligned substantially on a straight line in the main scanning direction of the apparatus main body.

In aligning the end portions of the nozzle arrays 21 as described above, as shown by FIG. 5B, the end portions are aligned by constituting a reference by the effective nozzle opening 20. Otherwise, the embodiment is similar to the above-described embodiment and the same members are attached with the same notations.

By the constitution, the third ink ejection units 3 prolong the length of the nozzle group 38 in the sub scanning direction in two kinds of modes of a state of being shifted in the main scanning direction and a state of the row substantially the same as that of the first ink ejection unit U1 and by pertinently selecting the former of the shifted state and the latter of the same row state, the nozzle group can be prolonged with a high degree of freedom.

Further, according to the embodiment, the second and the third ink ejection units U2 and U3 can commonly be used and therefore, a reduction in a kind of a part and a reduction in cost can be achieved.

Even when the single unit 39 formed by the first and the second ink ejection units U1 and U2 is arranged to shift to thereby bring about a shift at the end portion of the nozzle group 38, the shift can simply be corrected by adjusting the mode of arranging the third ejection unit U3.

Figure 9:
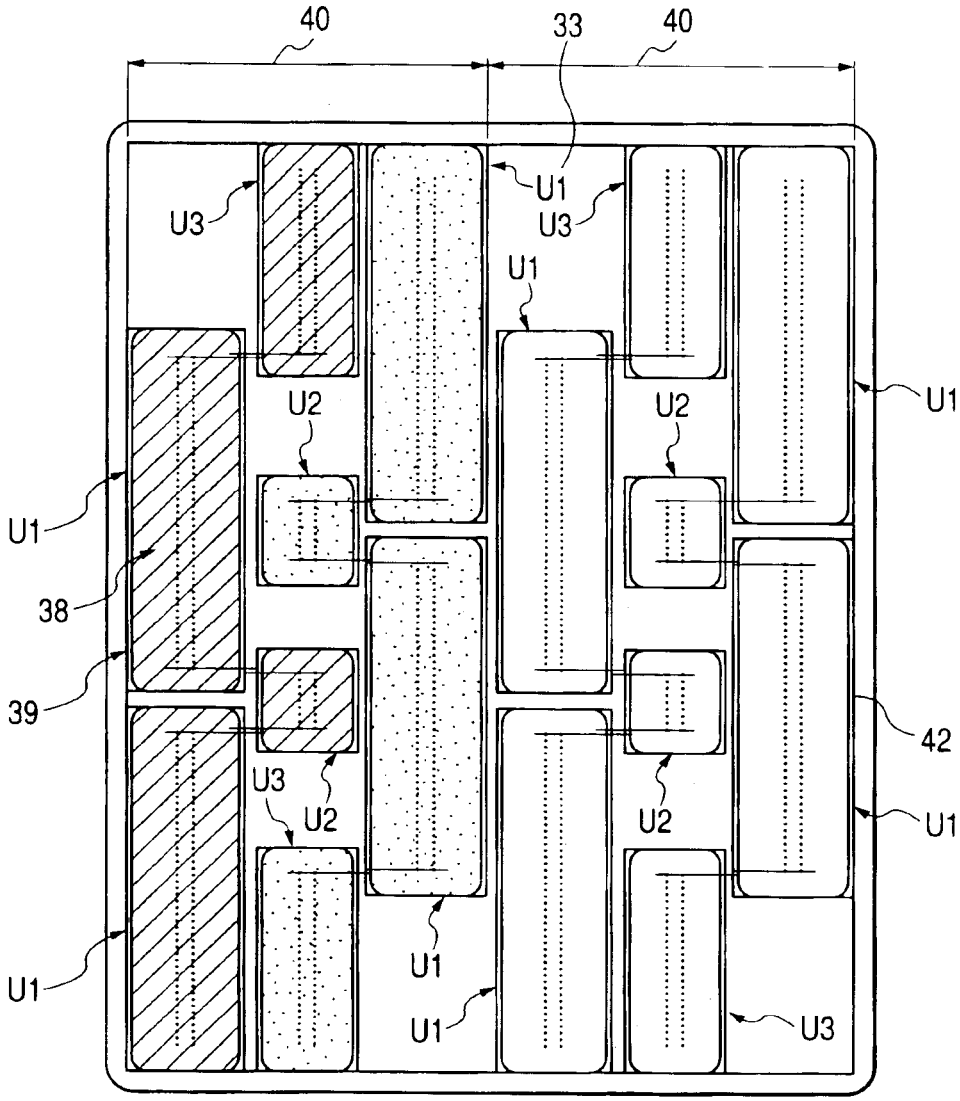
FIG. 9 is a plane view showing an embodiment of a liquid ejection head constituted by attaching the respective ink ejection units shown in FIG. 7 to the head holder as a mode of aligning the nozzle arrays.

According to an embodiment shown in FIG. 9, the third ink ejection unit U3 is made longer than that of the Embodiment of FIG. 8 and according to the embodiment, long length formation of the nozzle array can be achieved by effectively utilizing a dead space at which the second ejection unit U2 is not present.

Figure 10:
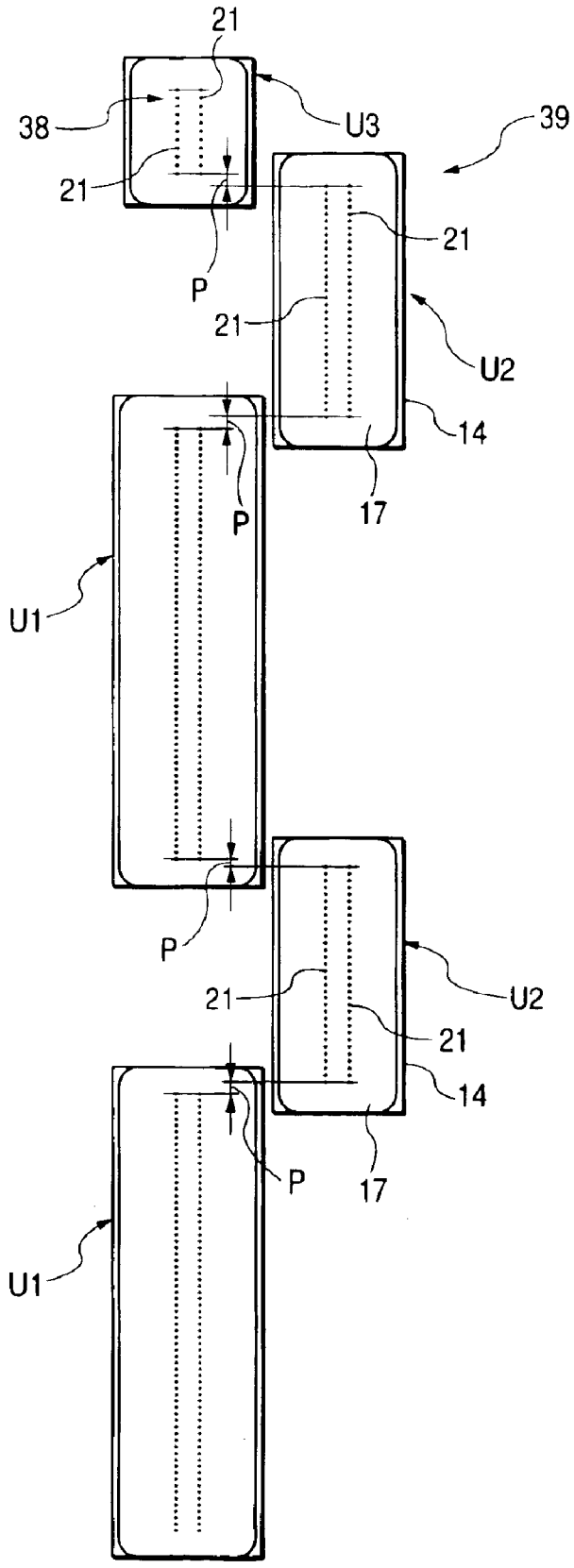
FIG. 10 is a plane view showing an embodiment of a single unit constituted by ink ejection units as a mode of aligning nozzle arrays.

FIG. 10 shows a basic mode of a nozzle array according to a third embodiment of the liquid ejection head of the invention, although the mode of aligning the respective ink ejection units is basically similar to that shown by FIG. 7 and FIG. 8, mentioned above, the length of the second ink ejection unit U2 in the nozzle array direction (sub scanning direction) is selected to a length at a middle of the longest first ink ejection unit U1 and shortest third ink ejection unit U3 and the other constitution is similar to those of the above-described respective embodiments and the same portions are attached with the same notations.

Figure 11:
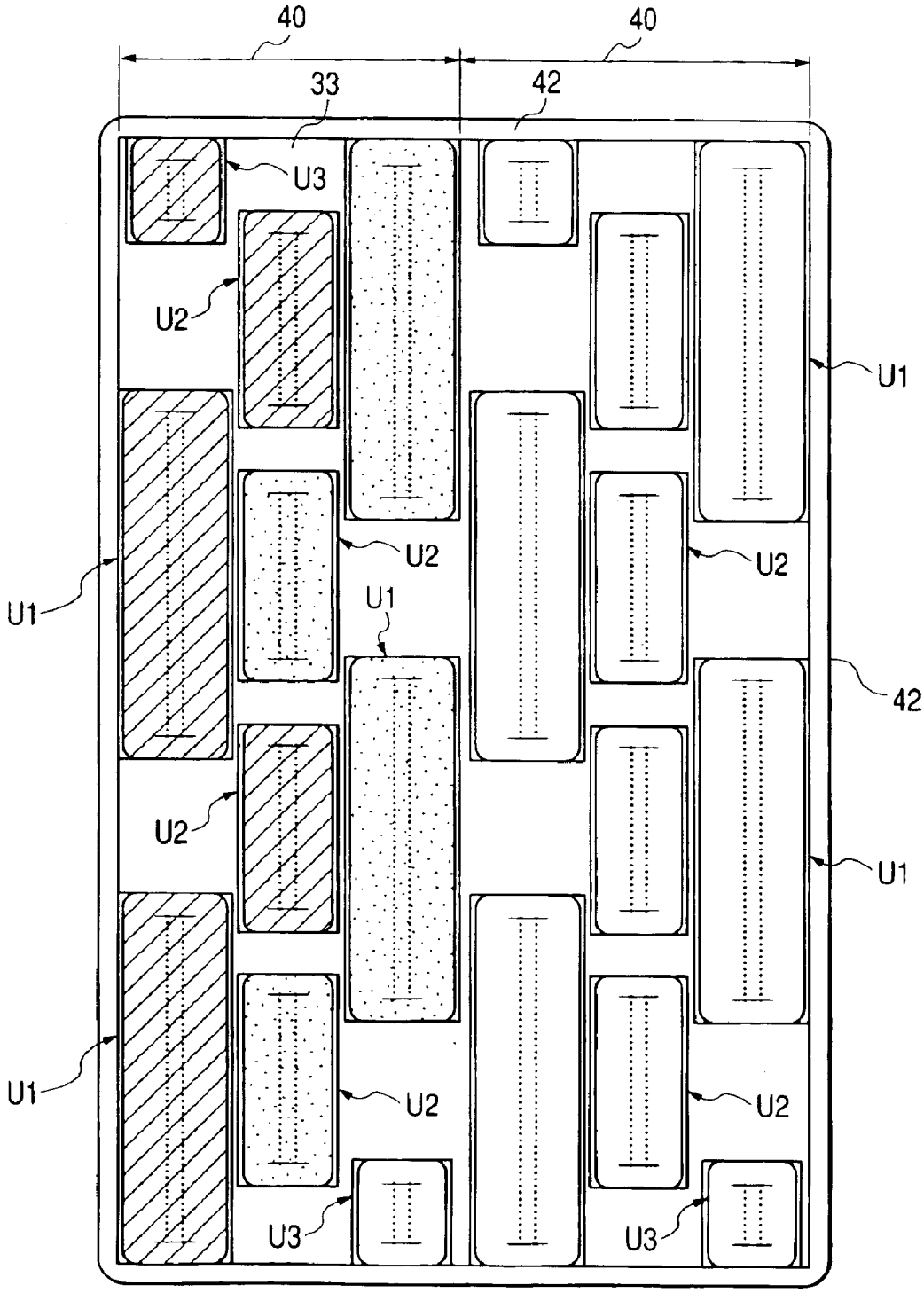
FIG. 11 is a plane view showing an embodiment of a liquid ejection head constituted by attaching the single units of FIG. 10 to a plurality of head holders.

By arranging the second ink ejection unit U2 constituted by the middle length and the shortest third ink ejection unit U3 by the above-described constitution, even when the mode of the opposed arrangement is adopted as shown by FIG. 11, the second ink ejection units U2 can be arranged on the same line in the sub scanning direction, the total length of the nozzle group 38 can significantly be prolonged while reducing the width in the main scanning direction as less as possible, which is further effective in high speed formation of printing. Otherwise, operation and effect similar to those of the above-described respective embodiments are achieves.

Figure 12:
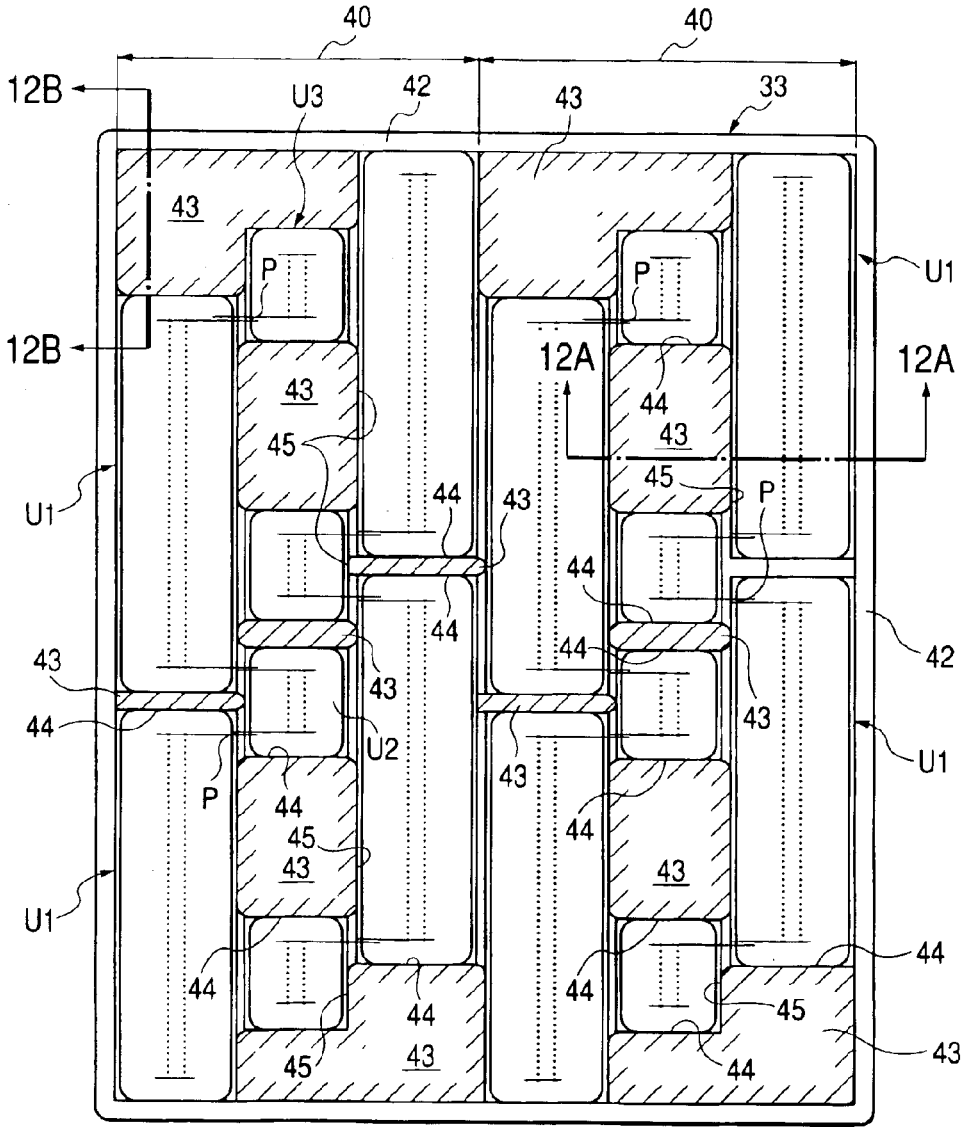
FIG. 12 is a plane view showing a fourth embodiment of a liquid ejection head according to the invention and showing a state of attaching respective ejection units to ahead holder.
Figure 13A:
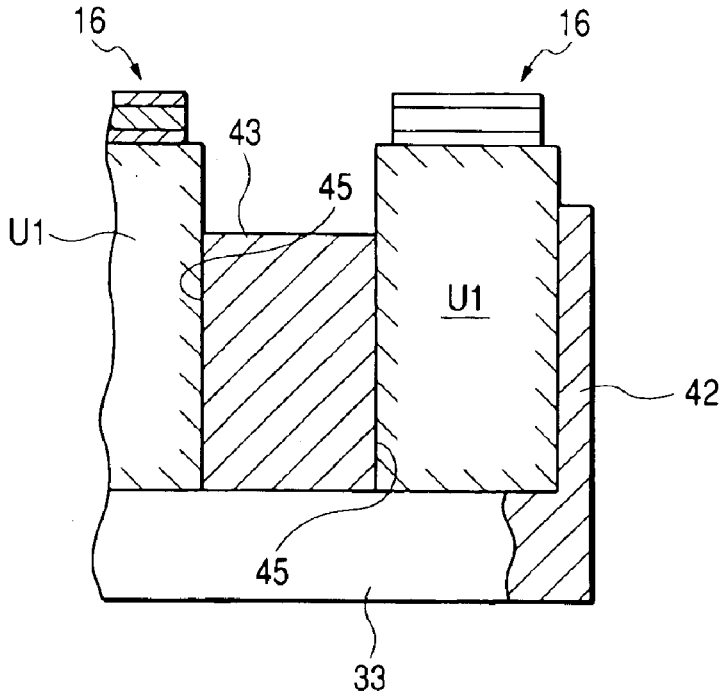
FIG. 13A is a sectional view taken along a line 12A—12A in FIG. 12
Figure 13B:
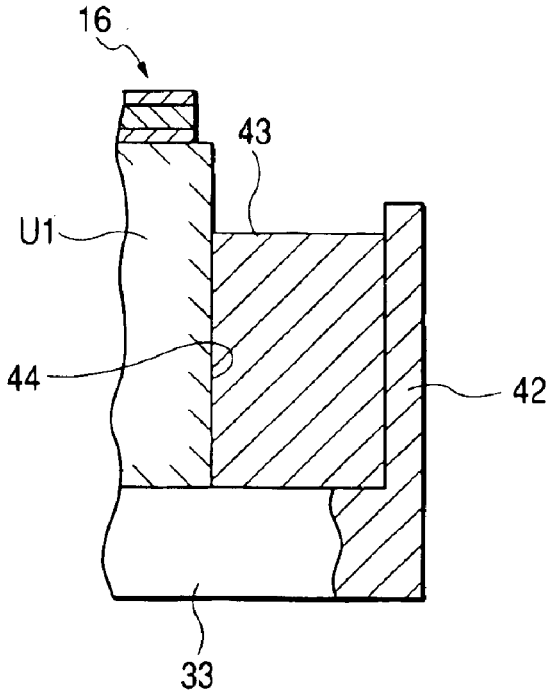
FIG. 13B is a sectional view taken along a line 12B—12B of FIG. 12.

FIG. 12 and FIG. 13 show an embodiment of the head holder constituting a member of attaching the respective ejection units of the liquid ejection head according to the invention, an outer peripheral wall member 42 for positioning is formed at a surrounding of the head holder 33 in a rectangular shape, a plurality of the first ink ejection units U1 are fixed to an inner face of the outer peripheral wall member 42 as a reference face to be fixed thereto and relative positions of the respective nozzle arrays 21 of the first ink ejection units U1 are constituted to position with high accuracy.

Further, the positioning reference is constituted not only by the inner face of the positioning outer peripheral wall member 42 but positioning projected portions 43 are provided at the head holder 33 preferably integrally therewith at regions of the head holder 33 for containing the respective ink ejection units U1, U2 and U3. The projected portion 43 is formed in a shape of a block and is formed with a reference face 44 for prescribing a reference position in the sub scanning direction by constraining movement of each of the units U1, U2 and U3 in a direction orthogonal to the main scanning direction (up and down direction in the drawing, the sub scanning direction) and a reference face 45 prescribing a reference position in the main scanning direction by constraining movement of each of the units U1, U2 and U3 in the main scanning direction. Otherwise, the embodiment is similar to the above-described respective embodiments and similar portions are attached with the same notations.

By the above-described constitution, the single unit 39 and the nozzle group 38 can be formed with high accuracy by containing the ink ejection units U1, U2 and U3 to be fixed to the head holder 33 with the inner face of the outer peripheral wall member 42 and the reference faces 44 and 45 of the projected portions 43 as the positioning references and ink droplets can be delivered from the prolonged nozzle group 38 at highly accurate positions.

Further, stabilized delivery of ink droplets is achieved as the opposed unit 40 opposing the single units 39 as a whole Further, even the nozzle openings 20 are constituted by a half pitch by shifting the nozzle arrays 21 of the single units 39 contiguous to each other, highly accurate pitch P/2 can be ensured.

Further, the head can be integrated by the respective ink ejection units U1, U2 and U3 by attaching the respective units U1, U2 and U3 to the head holder 33 with high accuracy by simple operation of charging the respective ejection units U1, U2 and U3 to regions prescribed by the outer peripheral wall member 42 for positioning and the respective positioning projected portions 43.

Figure 14:
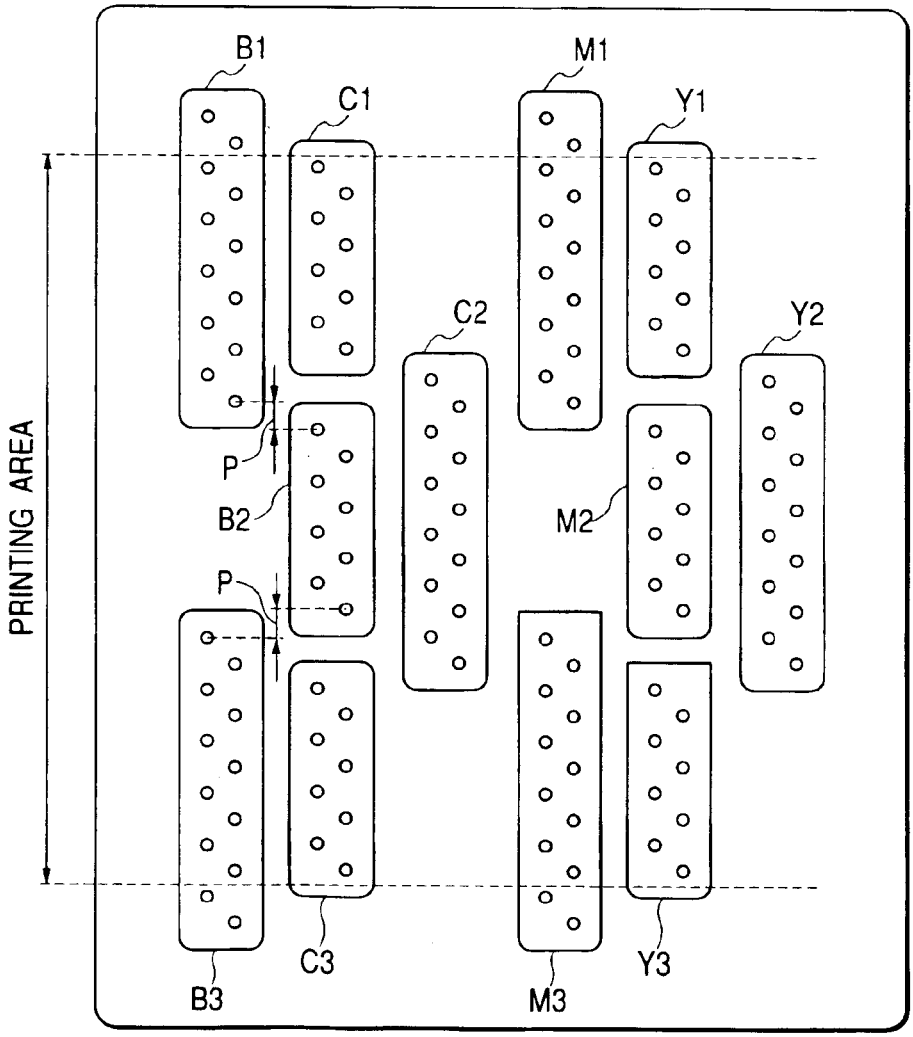
FIG. 14 is a view showing an embodiment of a liquid ejection head according to the invention by a mode of aligning nozzle openings.

FIG. 14 is a view showing an embodiment of applying the ink ejection head to a recording head by a state of aligning the nozzle openings and according to the embodiment, basically, there is constituted a color ink jet recording head for delivering inks of black, cyan, magenta and yellow by combining two kinds of the ink ejection units U1 and U2.

Figure 15A:
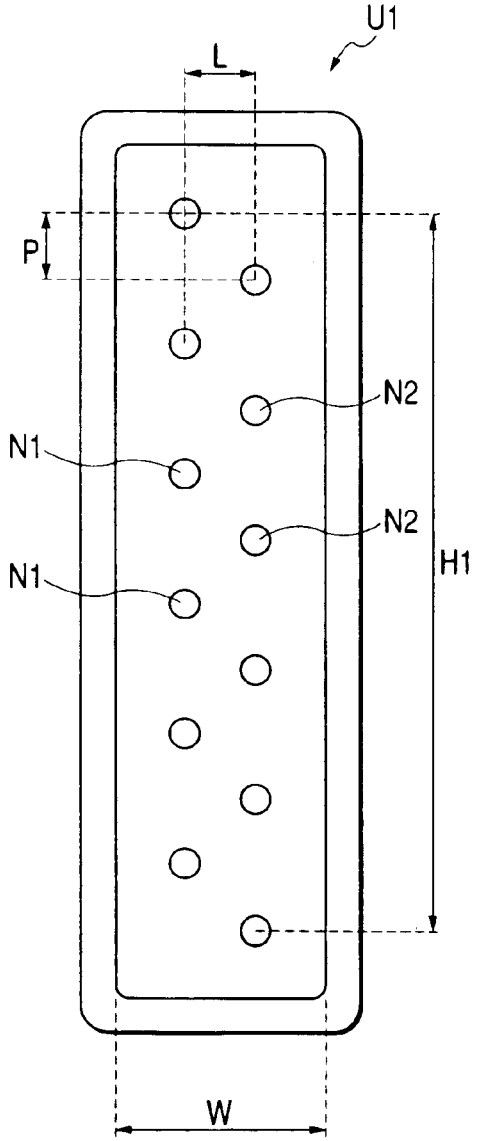
FIGS. 15A and 15B are views showing an embodiment of units respectively constituting a liquid ejection head according to the invention by a mode of aligning nozzle openings.
Figure 15B:
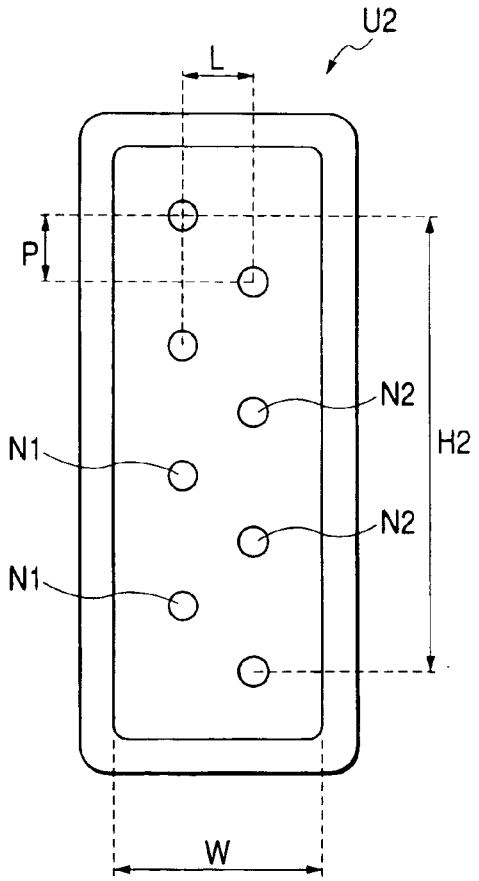

As shown by FIGS. 15A and 15B, the respective ink ejection units U1 and U2 are constituted such that although a width W, a distance L between nozzle opening rows and the pitch P of the nozzle openings substantially stays the same, nozzle opening numbers n1 and n2 differ from each other and therefore, print widths H1 and H2 in the sub scanning direction differ from each other.

Rows of nozzle openings for delivering black ink are constituted by arranging two of the ink ejection units U1 each having a larger number of nozzle openings to dispose on the same line in parallel with the sub scanning direction at a constant interval therebetween, that is, at an interval which can be interpolated by nozzle openings of the ink ejection unit U2 having a smaller number of nozzle openings and arranging the ink ejection units U2 shifted in the main scanning direction by a constant distance to fill the interval (further, hereinafter, units for forming rows of nozzle openings of black ink are referred to as ink ejection units B1 through B3).

Rows of nozzle openings for delivering cyan ink are constituted by being arranged to dispose on lines the same as those of the ink ejection units B2 at an interval of distance which can be interpolated by the ink ejection unit U1 in the sub scanning direction and arranging the unit U1 by being shifted in the main scanning direction to fill the interval, that is, at a prescribed interval from the nozzle opening of the contiguous ink ejection unit (further, hereinafter, ink ejection units forming rows of nozzle openings of cyan ink are referred to as ink ejection units C1 through C3).

Rows of nozzle openings for delivering magenta ink are constituted by arranging two of the ink ejection units U1 each having a larger number of nozzle openings at a constant interval to dispose on the same line in parallel with the sub scanning direction, that is, at an interval which can be interpolated by the nozzle openings of the ink ejection units U2 each having a smaller number of nozzle openings and arranging the ink ejection units U2 by being shifted in the main scanning direction to fill the interval similar to the rows of nozzle openings for delivering the black ink, mentioned above (further, hereinafter, ink ejection units for forming rows of nozzle openings of magenta ink are referred to as ink ejection units M1 through M3).

Rows of nozzle openings for delivering yellow ink are constituted by being arranged to dispose on lines the same as those of the ink ejection unit M2 at an interval of a distance which can be interpolated by the ink ejection units U1 in an up and down direction thereof and arranging the ink ejection unit U1 by being shifted in the main scanning direction to fill the interval similar to rows of nozzle openings for delivering cyan ink, mentioned above (further, hereinafter, ink ejection units for forming rows of nozzle openings of yellow ink are referred to as ink ejection units Y1 through Y3).

Further, in the nozzle openings of the ink ejection units U1 arranged in the up and down direction, two nozzle openings at an upper end and two nozzle openings at a lower end are driven not to deliver ink droplets and driven such that heights of printing areas in the respective rows are the same.

According to the embodiment, the dead space can be reduced in comparison with the case in which a plurality of ink ejection units having the same size are simply arranged in a zigzag shape.

In printing, explaining by taking an example of rows of nozzle openings of black ink, dots are formed by outputting print data dealt with by the ink ejection units B1 and B3 thereto and outputting print data dealt with by the ink jet unit B2 thereto at a time point at which a time period required for moving a distance of the ink ejection units B1 and B3 and the ink ejection unit B2 has elapsed, the dots of the ink ejection units B1 through B3 can be formed on the same line extended in the paper feeding direction.

By driving similarly the nozzle opening rows for delivering other inks, the dots by the respective inks can be formed on the same line extended in the sub scanning direction.

Figure 16:
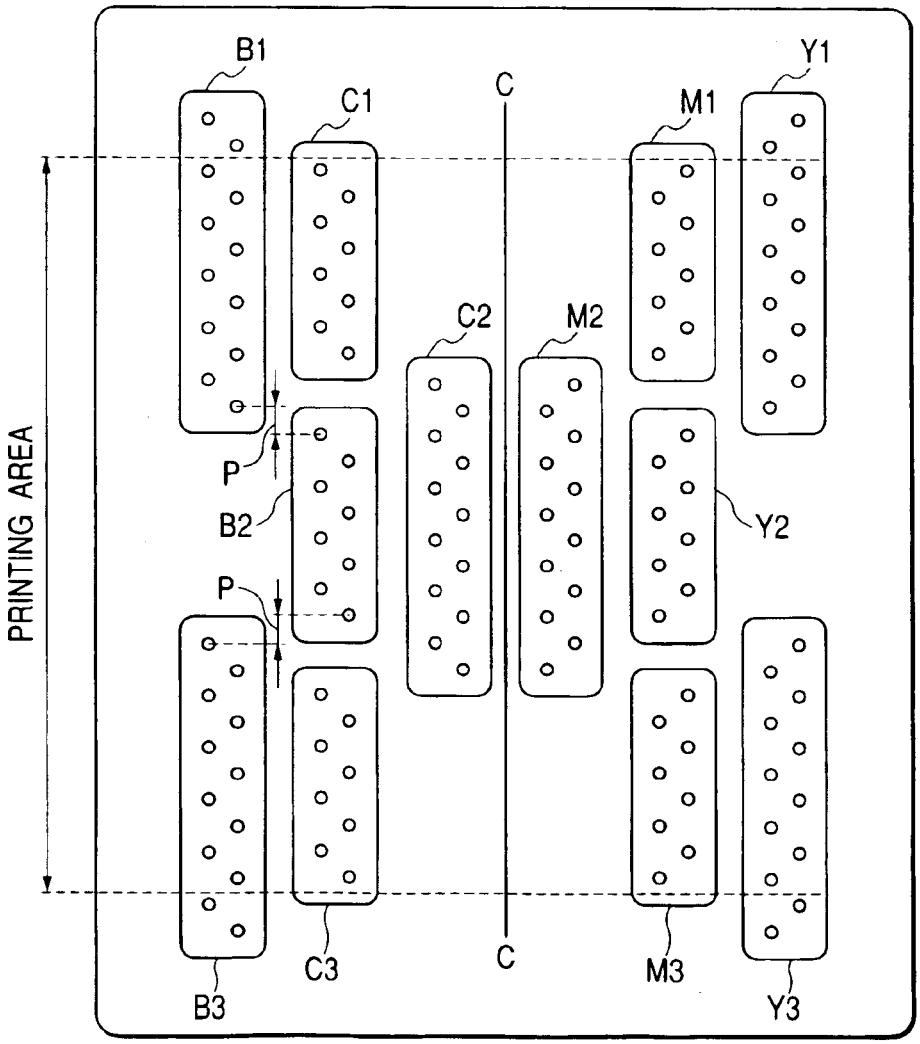
FIG. 16 is a view showing other embodiment of a liquid ejection head according to the invention by a mode of aligning nozzle openings.
Figure 17A:
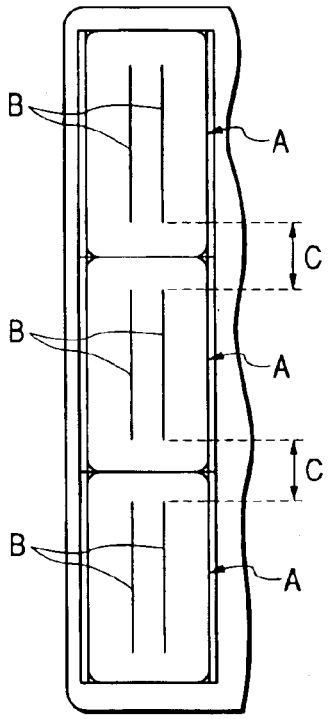
FIGS. 17A and 17B are plane views showing an example of a conventional liquid ejection head respectively constituted by a plurality of ink ejection units.
Figure 17B:
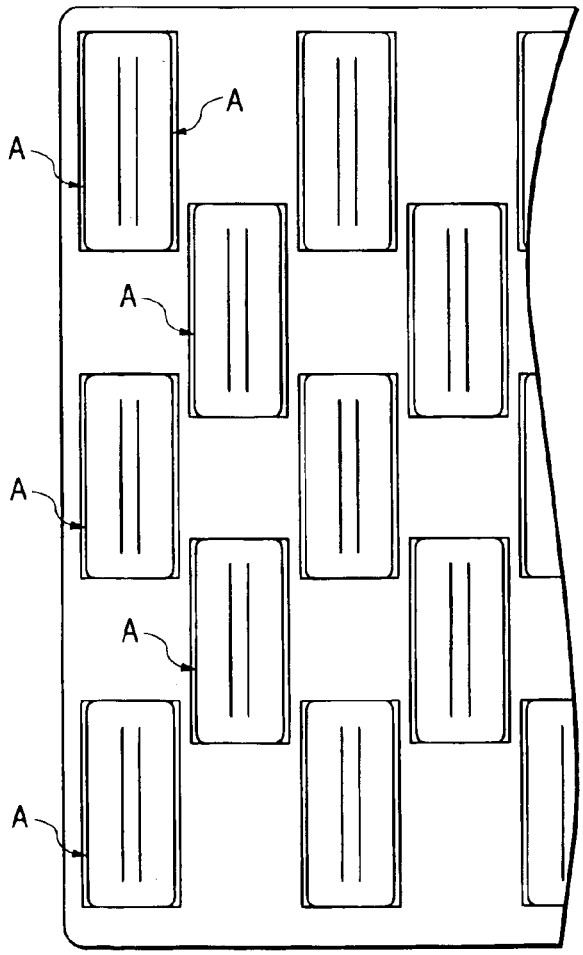

FIG. 16 shows other embodiment of the liquid ejection head according to the invention and although rows of nozzle openings for delivering black ink and cyan ink are formed similar to the above-described embodiment, a mode of forming rows of nozzle openings of magenta ink and yellow ink slightly differs therefrom.

That is, according to the embodiment, the ink ejection units B1 through B3 and the ink ejection units C1 through C3 for forming rows of nozzle openings for forming black ink and cyan ink are constituted to be arranged to be symmetrical relative to a central line C—C of the recording head.

According to the embodiment, although timings of driving the rows of nozzle openings of magenta ink and yellow ink slightly differ from those of the above-described embodiment, when timings of delivering ink droplets are adjusted in correspondence with an amount of shifting in the main scanning direction, dots of magenta ink and yellow ink can be formed on the same line extended in the paper feeding direction and with regard to the dead space, the dead space can be reduced in comparison with the case of arranging a plurality of ink ejection units having the same size simply in the zigzag shape.

Further, although according to the above-described embodiment, the explanation has been given of a case of forming rows of nozzle openings capable of delivering four kinds of different inks, by increasing or reducing numbers of a mode of combining the ink ejection units represented by rows of nozzle openings of black ink, that is, the mode of arranging two of the units U1 each having a larger number of nozzle openings to be interpolated by the ink ejection units U2 each having a smaller number of nozzle openings and arranging the ink ejection units U2 to be shifted in the paper width direction to fill the interval, and a mode of combining the ink ejection units represented by rows of nozzle openings of cyan ink, that is, a mode of arranging two of the ink ejection units U2 each having a smaller number of nozzle openings to be interpolated by the ink ejection units U1 each having a larger number of the nozzle openings and arranging the ink ejection units U1 to be shifted in the paper width direction to fill the interval (direction of moving the ejection head), the liquid ejection head capable of delivering different kinds of inks of pertinent numbers can be constituted.

Although an explanation has been given of the above-described embodiments in the case of applying to the ink jet type recording apparatus by using the liquid ejection head as the recording head for ejecting ink droplets, glue, manicure, conductive liquid (liquid metal) or the like can be ejected. For example, the invention is generally applicable to use for coating and ejecting a liquid agent as a small amount of liquid droplets such as a colorant ejection head used in fabricating a color filter of a liquid crystal display or the like, an organic EL display, an electrode forming agent ejection head used for forming an electrode of EFD (face emission display) or the like, a liquid ejection head for delivering a liquid of a living body organic substance ejection head used for fabricating a bio chip.

What is claimed is:

1. A liquid ejection head comprising:

a plurality of liquid ejection units each of which includes a flow path unit formed by a laminated structure provided with a nozzle plate on which a nozzle array aligning nozzle openings is formed, a flow path forming plate in which a pressure generating chamber communicating with the nozzle opening, and a sealing plate for closing an opening of the pressure generating chamber; and a head holder to which said liquid ejection units are attached for guiding a liquid from a liquid supply source;

wherein said liquid ejection units includes at least two of first liquid ejection units that are aligned so that the respective nozzle arrays are aligned in a first direction, and each of which has a first length in the first direction, a second liquid ejection unit having a second length in the first direction shorter than the first length, the second liquid ejection unit is arranged at a discontinuous portion of the nozzle arrays between two adjacent ones of the first liquid ejection units in a state of being shifted from an alignment of the first liquid ejection units in a second direction, whereby a single unit of the liquid ejection units is constituted by the first liquid ejection units and at least one of the second liquid ejection unit such that the respective nozzle arrays constitutes a single nozzle group for ejecting the same kind of a liquid.

2. The liquid ejection head according to claim 1, wherein two single units of the liquid ejection units are provided so that the respective second liquid ejection units in said two single units of the liquid ejection units overlap each other in a direction orthogonal to the first direction in a state of shifting the two units of the liquid ejection units in the first direction.

3. The liquid ejection head according to claim 2, wherein the nozzle arrays of the single units contiguous to each other in view from the second direction are arranged such that an opening pitch of the nozzle array of other of the single units is shifted from an opening pitch of the nozzle array of one of the single units and an amount of the shift is an amount of a half of the opening pitch.

4. The liquid ejection head according to claim 1, wherein an opposed unit is formed by opposingly arranging at least two single units of the liquid ejection units in a state of being shifted from each other in the first direction to thereby arrange the respective second liquid ejection units in said at least tow single units substantially on a same row.

5. The liquid ejection head according to claim 4, wherein a plurality of the opposed units are arranged.

6. The liquid ejection head according to claim 1, wherein the single unit includes at least one third liquid ejection unit having a third length for extending a total length of the nozzle group of the single unit by a predetermined length, and the nozzle group is constituted by the respective nozzle arrays of the first, the second and the third liquid ejection units.

7. The liquid ejection head according to claim 6, wherein at least one of the third liquid ejection unit is arranged substantially in a row the same as the row of the second liquid ejection unit.

8. The liquid ejection head according to claim 7, wherein at least one of the third liquid ejection unit is arranged at a row substantially the same as a row of the first liquid ejection unit.

9. The liquid ejection head according to claim 8, wherein the third length of the third liquid ejection unit and the second length of the second ejection unit are substantially the same.

10. The liquid ejection head according to claim 7, wherein end portions of the nozzle groups between a plurality of the single units are aligned substantially on a straight line in the second direction by the third liquid ejection unit.

11. The liquid ejection head according to claim 1, wherein the head holder is provided with a projected portion for positioning at least one of the first liquid ejection unit, the second liquid ejection unit and the third liquid ejection unit.

12. The liquid ejection head according to claim 1, wherein the head holder is provided with an outer peripheral wall member for positioning at least one of the first liquid ejection unit, the second liquid ejection unit or the third liquid ejection unit.

13. The liquid ejection head according to claim 1, wherein the liquid ejection units are constituted by bonding the flow path units to the head case, and a pressure generating element for producing a pressure variation in the pressure generating chamber is constituted by a piezoelectric oscillator of a vertical oscillation mode, the piezoelectric oscillator is fixed to a fixing board, the piezoelectric oscillator and the fixing board are inserted into a containing chamber provided at the head case in a state of corresponding to the pressure generating chamber and the fixing board is brought into a fixed state at inside of the containing chamber.

* * * * *